US007798742B2

(12) United States Patent
Nolle et al.

(10) Patent No.: US 7,798,742 B2
(45) Date of Patent: Sep. 21, 2010

(54) SECURITY KEY TOOL FOR MANHOLE ACCESS OPENING SECURITY DEVICE

(75) Inventors: Eric R. Nolle, South Wales, NY (US); Jeffrey R. Sullivan, Boston, NY (US)

(73) Assignee: McGard, LLC, Orchard Park, NY (US)

( * ) Notice: Subject to any disclaimer, the term of this patent is extended or adjusted under 35 U.S.C. 154(b) by 674 days.

(21) Appl. No.: 11/736,634

(22) Filed: Apr. 18, 2007

(65) Prior Publication Data

US 2008/0256997 A1 Oct. 23, 2008

(51) Int. Cl.
*E02D 29/14* (2006.01)

(52) U.S. Cl. ..... 404/25; 52/19; 294/23

(58) Field of Classification Search ..... 404/25, 404/26; 254/131; 49/49; 294/16, 23
See application file for complete search history.

(56) References Cited

U.S. PATENT DOCUMENTS 1,287,290 A * 12/1918 Burton ..... 49/35
1,400,399 A * 12/1921 Yaeche ..... 49/465
1,458,391 A * 6/1923 Thomas ..... 137/371
2,363,567 A * 11/1944 Blakeman ..... 292/6
3,772,828 A * 11/1973 Chahley ..... 49/465
3,797,286 A * 3/1974 Saporito ..... 70/169
3,837,622 A * 9/1974 Gale ..... 254/131
4,577,478 A * 3/1986 Economopoulos et al. .... 70/168
4,723,866 A 2/1988 McCauley
4,902,165 A * 2/1990 Embree ..... 404/25
4,964,755 A 10/1990 Lewis et al.
5,070,564 A * 12/1991 Fey ..... 7/170
5,082,392 A 1/1992 Marchese et al.
5,328,291 A * 7/1994 Wisniewski ..... 404/2
5,827,007 A 10/1998 Barton et al.
6,550,294 B2 4/2003 Garguilo
6,881,007 B2 4/2005 Dennis
7,201,534 B2 * 4/2007 Dennis ..... 404/25
7,347,070 B1 * 3/2008 Spector ..... 70/169
7,704,010 B2 * 4/2010 Nolle et al. ..... 404/25

FOREIGN PATENT DOCUMENTS

GB 2257736 A * 1/1993

OTHER PUBLICATIONS

"Manhole Protection Underground Infrastructure Security," Manhole Barrier Security Security Systems, Inc., 2006, 4 pages.

* cited by examiner

*Primary Examiner*—Raymond W Addie
(74) *Attorney, Agent, or Firm*—Walter W. Duft

(57) ABSTRACT

A security key tool for unlocking and locking a manhole security device that secures a manhole access opening. The security key tool includes a longitudinal body portion and a handle portion. A security key at a first end of the longitudinal portion is adapted to engage a security lock on the security device for actuating a locking mechanism on the security device to an unlocked position. A slidable member may be used to help engage the security key to the security lock or to protect the security key. A latch release tool at a second end of the longitudinal portion is adapted to release a latch on the manhole security device for actuating the locking mechanism to a locked position. Optionally, the latch release tool may be disposed on a tool head that also includes a lifting tool adapted to engage and lift the security device away from a manhole frame after the security device is unlocked.

20 Claims, 30 Drawing Sheets

SECURITY KEY TOOL FOR MANHOLE ACCESS OPENING SECURITY DEVICE

CROSS-REFERENCE TO RELATED PATENT APPLICATIONS

This application relates to copending application Ser. No. 11/736,623, filed on even date herewith and entitled "Security Device for Manhole Access Opening."

BACKGROUND OF THE INVENTION

1. Field of the Invention

The present invention relates to lock systems for securing access to manhole openings.

2. Description of the Prior Art

By way of background, standard manhole covers are designed to be easily removed from manhole openings to allow access to underground facilities such as sewers, electrical and communication equipment vaults, and other infrastructure. This presents a security risk by allowing vandals, terrorists and others to gain unauthorized access to important assets, or to move about undetected via underground passageways.

Various manhole opening locking schemes have been proposed to address such security concerns. One technique is to simply bolt the manhole cover to the underlying manhole frame structure. Although very effective, this method either involves retrofitting existing manhole covers and frames by drilling and tapping bolt holes, or requires that existing covers and frames be replaced with units having preformed bolt holes. The former approach is very labor intensive and both alternatives may be prohibitively expensive if the number of manhole locations is large.

Another manhole security technique involves mounting a lock system to the underside of a manhole cover. A typical lock system includes a pair of retractable pins that extend horizontally to engage the side-wall of the manhole frame or the underside of the ring flange that supports the manhole cover. A long-handled, rotatable security key tool is used to rotate a locking mechanism that actuates the pins into and out of locking engagement. A disadvantage of this technique is its cost. Existing manhole covers must either be replaced with new covers having a pre-mounted lock system, or they must be retrofitted with the lock system. The latter approach requires drilling and tapping bolt holes for securing the lock system, and may also require the formation of an opening in the manhole cover to allow the security key tool to reach the lock mechanism. Alternatively, if the manhole cover has a pre-existing vent hole, this may be used for receiving the security key tool.

Still another manhole security technique involves the use of a lockable pan unit situated below a standard manhole cover. The pan unit is used to block the manhole opening, which means that the manhole cover itself does not require locking and does not have to retrofitted or replaced. The pan unit is secured to the manhole frame by resting it on the same ring flange that supports the manhole cover, and then locking the unit to the manhole frame. A lock system may be used that is similar to those described above for manhole cover-mounted lock systems.

A disadvantage of existing pan-style manhole security devices, as well as some cover-mounted lock systems, lies in their manner of operation. By way of example, U.S. Pat. No. 6,550,294 discloses a pan-style manhole security device wherein a universal joint gear system is provided for actuating a pair of locking pins using a security key tool. Because of the nature of the gear system, many turns of the security key tool are required to move the pins between their locked and unlocked positions, which may be undesirable. U.S. Pat. No. 4,964,755 discloses a manhole cover-mounted lock system wherein the pin-actuating locking mechanism requires only a ninety degree turn of the security key tool to operate a pair of locking pins. However, the locking pins are not self-locking and the security key must be used to return the pins to their locked position once the manhole cover is in place. Moreover, the position of the locking pins in the locked position is fixed by locating pins. Due to dimensional tolerances and differences between manhole frame designs, the locking pins may not firmly engage some manhole frames or may be overly tight in other manhole frames, requiring excessive force to lock the pan. U.S. Pat. No. 5,082,392 overcomes this problem by spring-biasing a pair of locking pins to their locked position. The locking pins affirmatively engage the manhole frame under the force of the biasing springs. A specially configured portion of the security key tool mates with an access aperture in the manhole cover when the locking pins are in their unlocked position. This allows the locking pins to be held in the unlocked position during opening and closing of the manhole opening. However, the security key tool must remain engaged with the manhole cover at all times when the cover is not covering the manhole, which may be inconvenient.

It is to improvements in manhole opening security systems that the present invention is directed. In particular, what is needed is a security key tool for use with a security device that improves upon previous designs by reducing the effort required to lock and unlock the device, which provides robust locking capability, and which utilizes an uncomplicated design that is easy to manufacture.

SUMMARY OF THE INVENTION

The foregoing problems are solved and an advance in the art is obtained by a security key tool for unlocking and locking a manhole security device that secures a manhole access opening. The security key tool includes a longitudinal body portion and a handle portion. A security key at a first end of the longitudinal portion is adapted to engage a security lock on the security device for actuating a locking mechanism on the security device to an unlocked position. A slidable member may be used to help engage the security key to the security lock or to protect the security key. A latch release tool at a second end of the longitudinal portion is adapted to release a latch on the manhole security device for actuating the locking mechanism to a locked position. Optionally, the latch release tool may be disposed on a tool head that also includes a lifting tool adapted to engage and lift the security device away from a manhole frame after the security device is unlocked.

An exemplary security device that may be locket and unlocked by the security key tool includes a circular barrier adapted to rest on a manhole cover support flange of a manhole frame. Locking members on the barrier are movable between a locked position in which the locking members are adapted to engage the manhole frame and an unlocked position in which the locking members are not adapted to engage the manhole frame. A biasing mechanism on the barrier biases each locking member to its locked position. A rotatable locking mechanism on the barrier engages the locking members and has a locking rotational position wherein the locking members are in the locked position and an unlocking rotational position wherein the locking members are in the unlocked position. The locking mechanism has a security lock adapted to receive the security key tool and allow it to supply a rotational torque to the locking mechanism. A latch on the barrier is adapted to releasably retain the locking mechanism in the unlocking rotational position without the security lock being engaged by the security key tool. The latch can be actuated by the security key tool's latch release tool when it is time to lock the security lock.

BRIEF DESCRIPTION OF THE DRAWINGS

The foregoing and other features and advantages of the invention will be apparent from the following more particular description of an exemplary embodiment of the invention, as illustrated in the accompanying Drawings, in which.

DETAILED DESCRIPTION OF EXEMPLARY EMBODIMENTS

Figure 1:
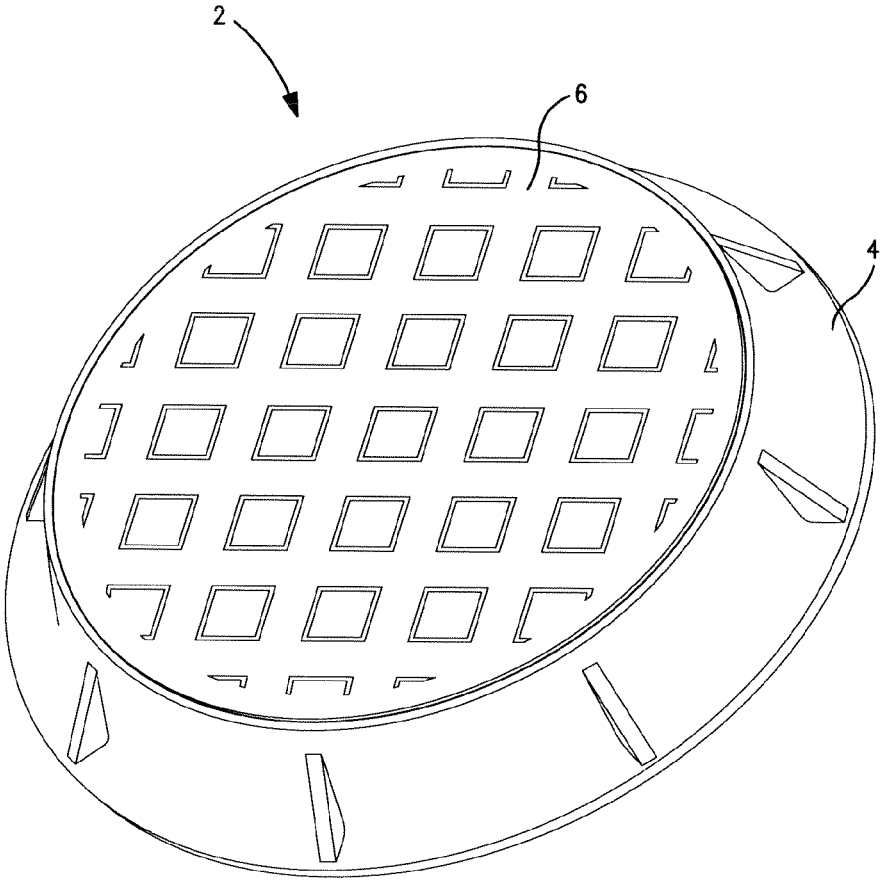
FIG. 1 is a perspective view showing a security manhole that includes a manhole frame and a manhole cover.
Figure 2:
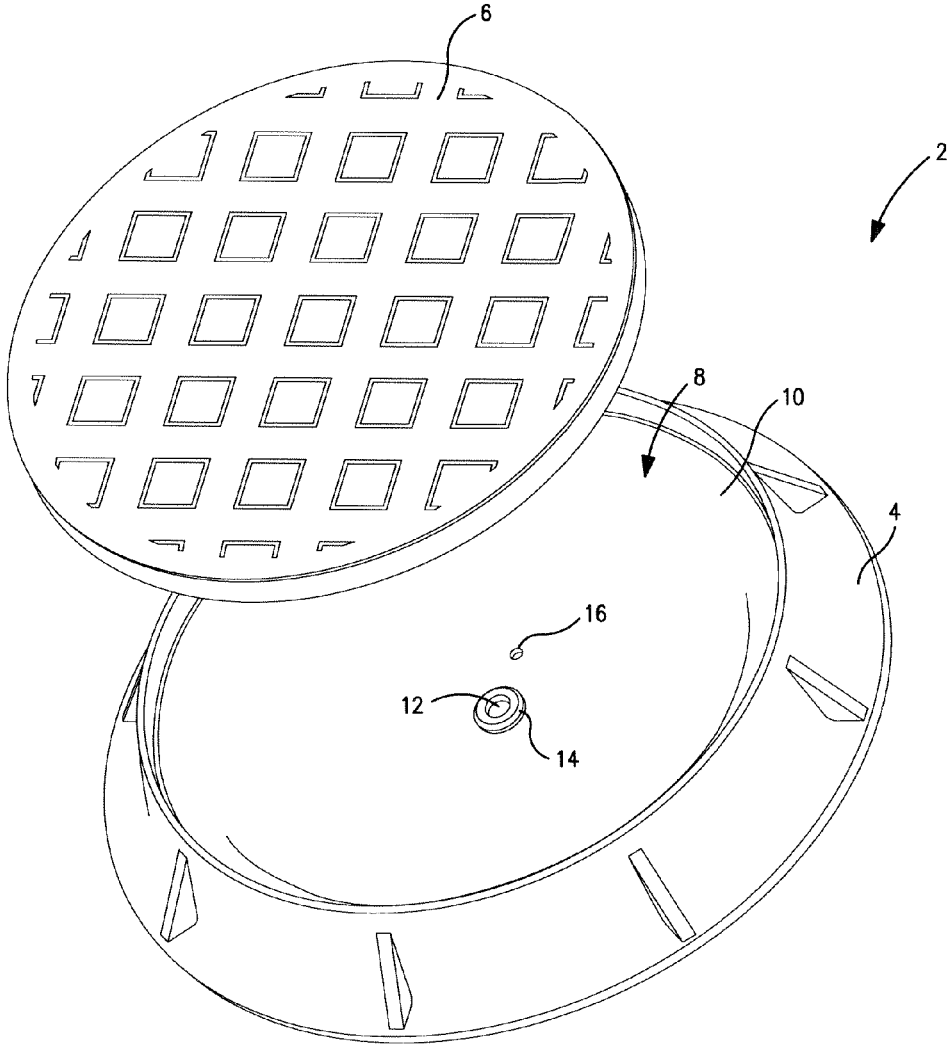
FIG. 2 is an exploded perspective view showing the security manhole of FIG. 1 with the manhole cover removed therefrom to reveal a manhole security device.
Figure 3:
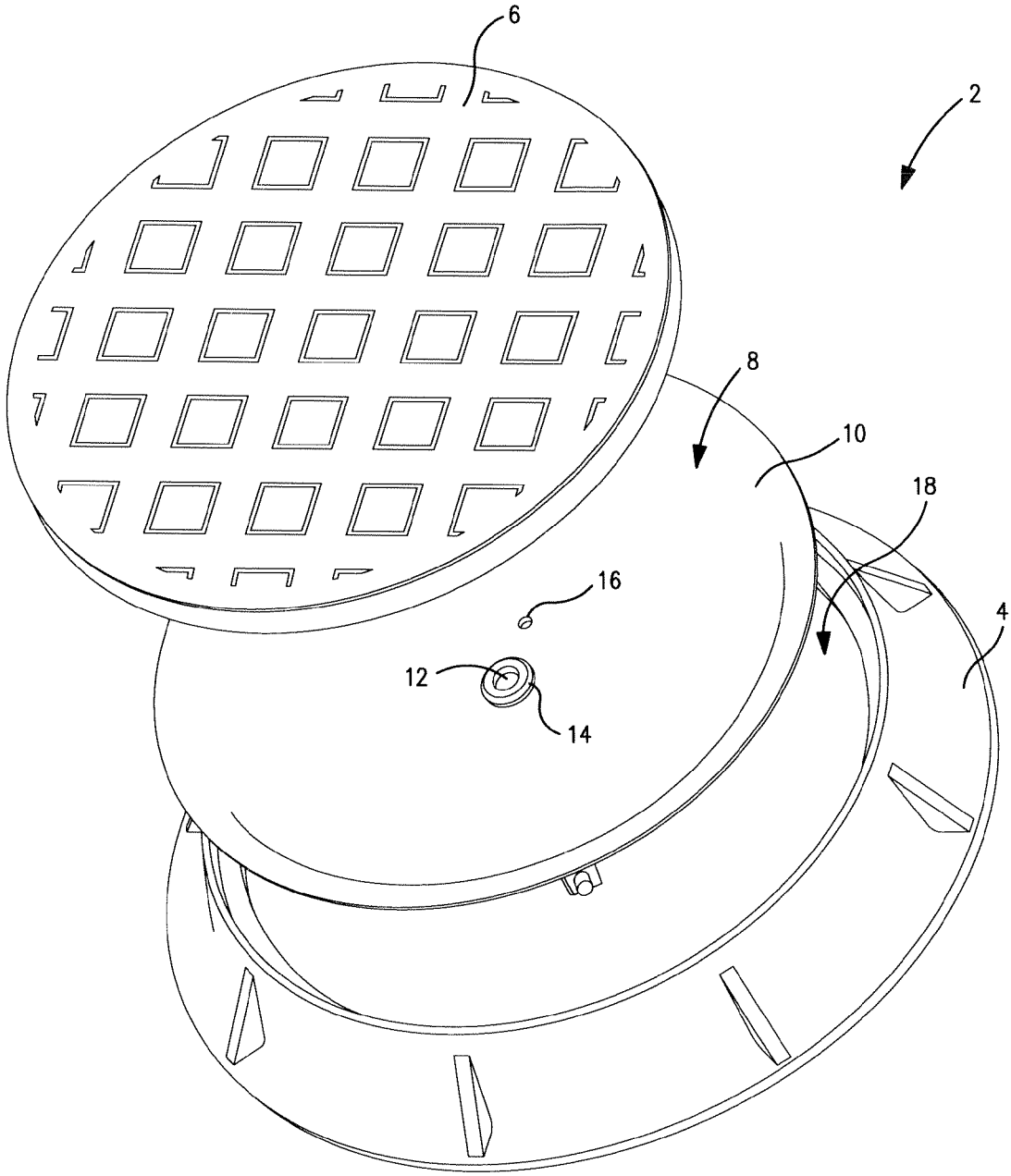
FIG. 3 is an exploded perspective view showing the security manhole of FIG. 1 with the manhole security device removed therefrom.

Turning now to the drawing figures wherein like reference numerals represent like elements in all of the several views, FIG. 1 illustrates a security manhole 2 that includes a manhole frame 4 and a manhole cover 6, both of which are of conventional design. As shown in FIG. 2, the security manhole 2 further includes a manhole security device 8 situated below the manhole cover 2. Unless otherwise indicated, it may be assumed that the components of the manhole security device 8 (to be described in more detail below) are formed from stainless steel or other high strength metal that is resistant to corrosion and other types of environmental degradation. Other materials may also be used, depending on design preferences. The manhole security device 8 includes a lockable pan 10 that is circular in shape and preferably strong enough and sufficiently stiff to withstand efforts to compromise the pan using hand tools such as crowbars, sledge hammers, etc. Centrally disposed on the pan 10 is a security lock 12 retained in a fitting that provides a lock housing 14. An access hole 16 may also be disposed on the pan 10 to provide an aperture for releasing a latch that maintains the manhole security device 8 in an unlocked position (as described in more detail below). As shown in FIG. 3, the manhole security device 8 can be unlocked when desired and removed from the manhole frame 4 to allow access to a manhole access opening 18.

Figure 4:
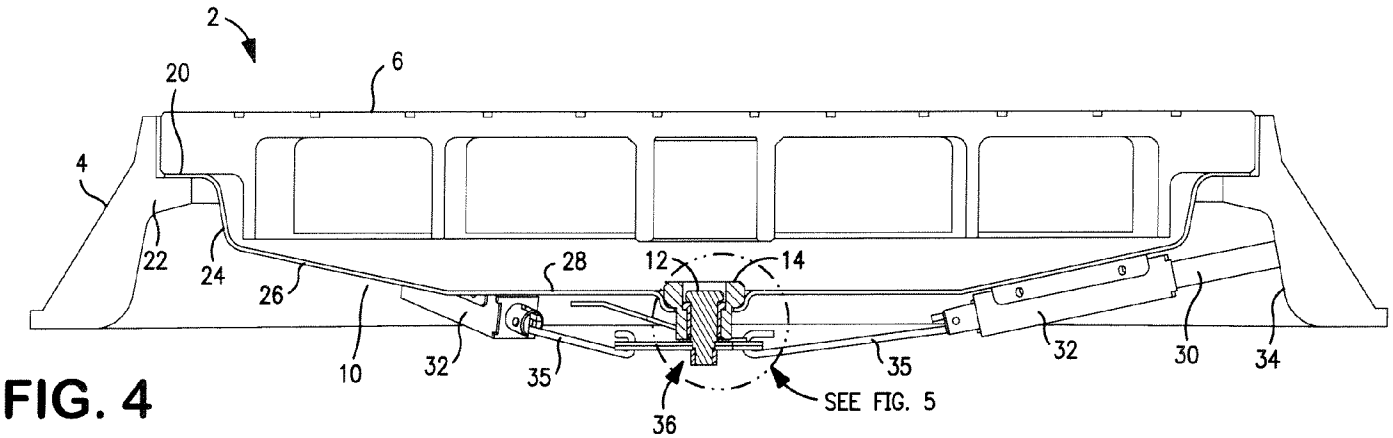
FIG. 4 is a cross-sectional centerline view of the security manhole of FIG. 1.

Turning now to FIG. 4, the pan 10 includes an annular rim 20 that is adapted to rest on an annular manhole cover support flange 22 of the manhole frame 4. Radially inwardly of the annular rim 20, the pan 10 transitions to a nearly-vertical, sharply-angled outer wall section 24 that extends downwardly to provide clearance for the bottom of the manhole cover 6. The lower edge of the outer wall section 24 of the pan 10 then transitions to a non-horizontal, gently-angled inner wall section 26. Radially inwardly of the inner wall section 26 is a central region of the pan 10 that is formed as a generally flat, horizontal section 28. In an alternative pan configuration, the inner wall section 26 could be formed so as to be generally horizontal. In that case, the horizontal section 28 would effectively extend to the outer wall section 24.

Two or more locking pins 30 (only one is shown in FIG. 4) are slideably mounted to locking pin mounts 32 on a lower side of the inner wall section 26 of the pan 10. Other types of locking members may also be used in lieu of the pins 30. The angle of the inner wall section 26 may be selected so as to be generally perpendicular to an angled side-wall 34 on the inside of the manhole frame 4. This orients the locking pins 30 so that they slant upwardly in generally perpendicular alignment with the side-wall 34, which may improve the ability to the locking pins to secure the manhole security device 8. Note that the ends of the locking pins 30 that engage the manhole frame 4 may be blunt or pointed, depending on design preference.

Figure 5B:
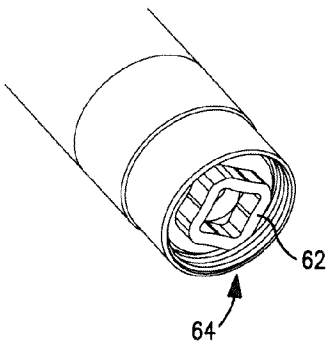
FIG. 5B is a perspective view of a security key for use with the manhole security device of FIG. 2.
Figure 5A:
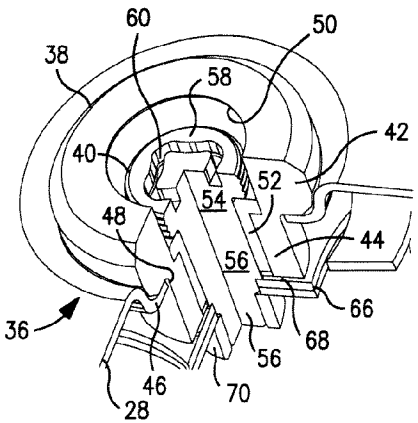
FIG. 5A is a perspective view of a security lock of the manhole security device of FIG. 2.
Figure 5:
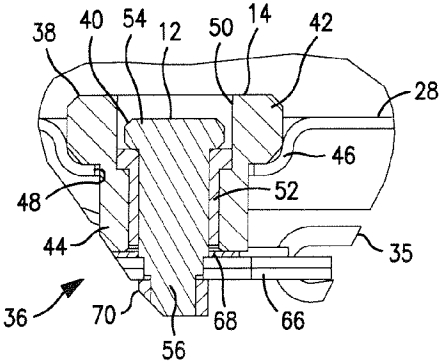
FIG. 5 is a cross-sectional centerline view of an upper portion of a locking mechanism of the manhole security device of FIG. 2.

The locking pins 30 are connected via link members 35 to a locking mechanism 36 that is centrally mounted on the pan 10. As additionally shown in FIG. 5, the locking mechanism 36 may include an apertured fitting 38 that provides the lock housing 14 of FIGS. 2 and 3, and a rotatable pin 40 whose exposed face is configured to provide the security lock 12, as also shown in FIGS. 2 and 3. The fitting 38 includes an upper head 42 and a downwardly-extending lower stem 44. The head 42 of the fitting 38 is received in a well 46 that may be formed in the horizontal section 28 of the pan 10. The well 46 has a central aperture 48 to accommodate the stem 44 of the fitting 38. The fitting 38 is formed with a stepped bore 50 that extends through the head 42 and the stem 44 in order to receive the pin 40. A bushing 52 made from brass or the like may be inserted in the bore 50 to facilitate rotation of the pin 40. The pin 40 includes an upper head 54 and a downwardly-extending lower stem 56. As shown in FIG. 5A, the top face 58 of the head 54 provides the security lock 12, and may be formed with an undulating curvilinear groove 60 or other security pattern. As shown in FIG. 5B, the groove 60 is configured to receive a mating curvilinear ridge 62 formed on a security key 64. The stem 56 of the head 54 mounts a locking pin actuator 66 that is secured thereto by way of a washer 68 and a retaining nut 70.

Figure 6:
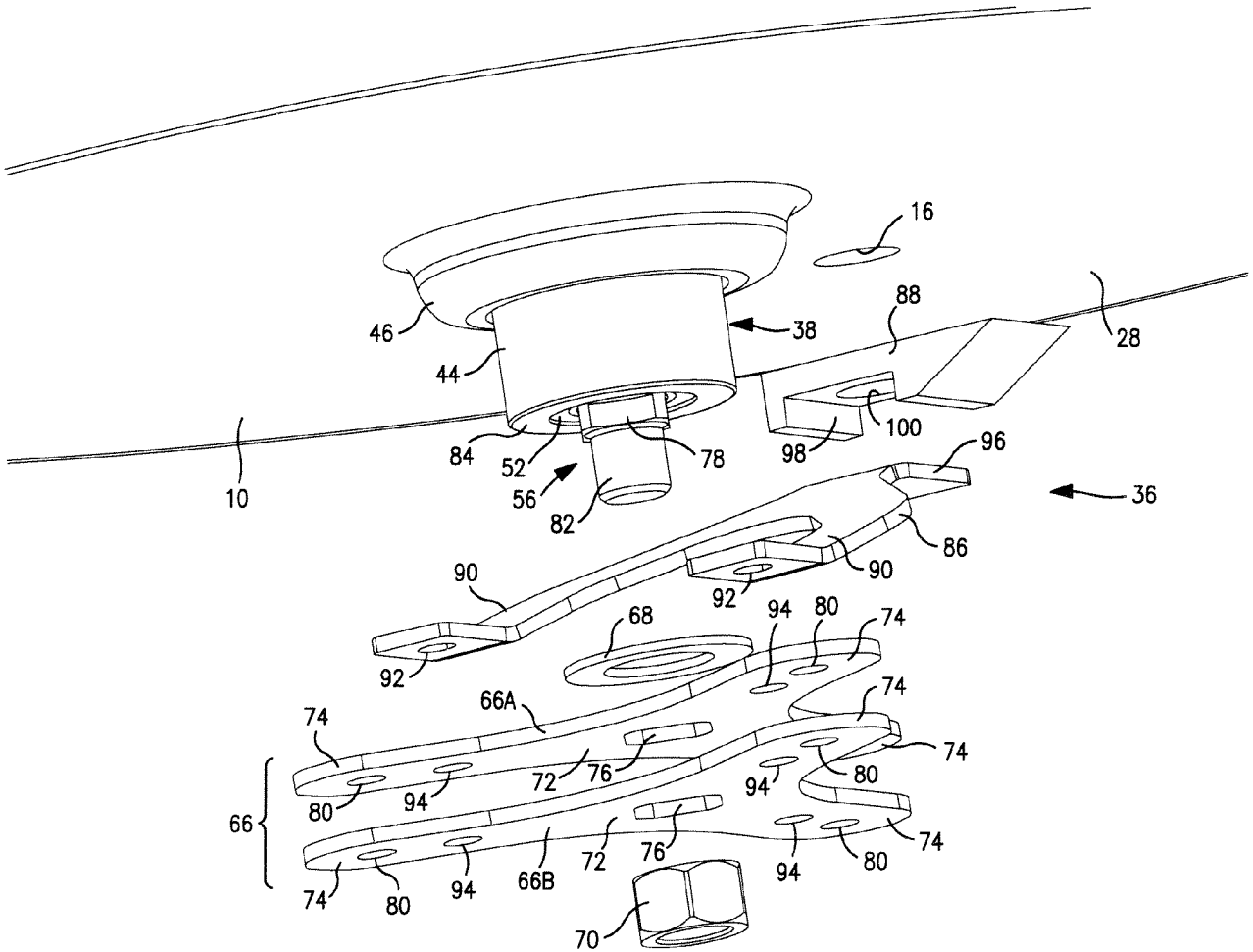
FIG. 6 is an exploded perspective view of a lower portion of a locking mechanism of the manhole security device of FIG. 2.

The locking pin actuator 66 and other components of the locking mechanism 36 are shown in more detail in FIG. 6. As can be seen therein, the locking pin actuator 66 may be constructed (for strength and stiffness reasons) as a two-element assembly having matching actuator members 66A and 66B. Each actuator member 66A/66B includes a central hub 72 and two or more arm members 74 (three are shown). The central hub 72 of each actuator member 66A/66B is formed with a key-way aperture 76 that fits a key-shaped rotational drive boss 78 formed on the stem 56 of the pin 40. The arm members 74 are each formed with an aperture 80 that provides an attachment point for one of the link members 35 that connect the locking mechanism 36 to the locking pins 30. A threaded lower end portion 82 is formed on the stem 56 of the pin 40 to engage the retaining nut 70. The washer 68 is disposed between the locking pin actuator 66 and a bottom face 84 of the stem 44 of the fitting 38. As described in more detail below, the locking mechanism 36 further includes a yoke-shaped latching member 86 that is adapted to engage a latch 88 secured to the bottom of the horizontal section 28 of the pan 10. The yoke portion of the latching member 86 includes a pair of legs 90, the ends of which are secured to two of the arm members 74 of the locking pin actuator 66. This attachment can be implemented using rivets or other fasteners (not shown) that extend through apertures 92 formed in the legs 90 of the latching member yoke portion and corresponding apertures 94 formed in the locking pin actuator arm members 74. The latching member 86 further includes a latching tab 96 that is adapted to be received in a latch channel 98 formed in the latch 88. An aperture 100 in center of the latch channel 98 is aligned with the aperture 16 formed in the pan 10.

Figure 7:
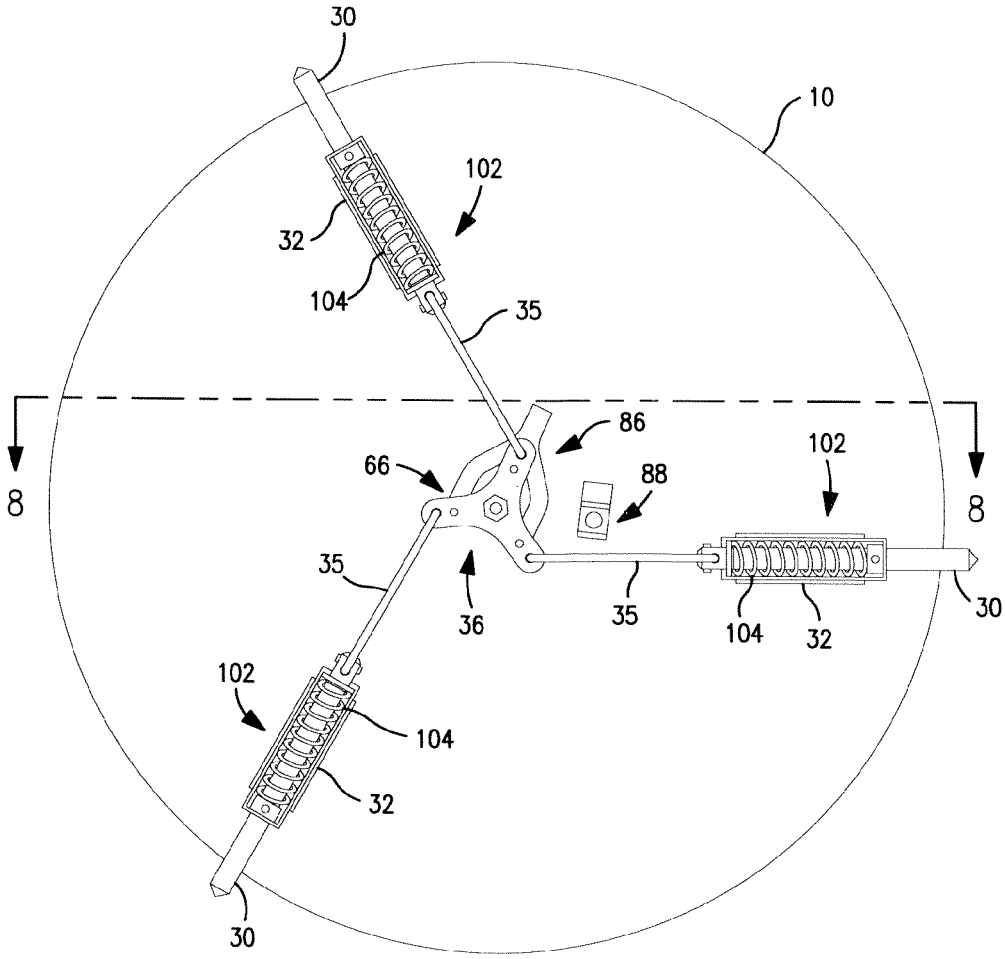
FIG. 7 is a bottom plan view of the manhole security device of FIG. 2 in a locked position.
Figure 8:
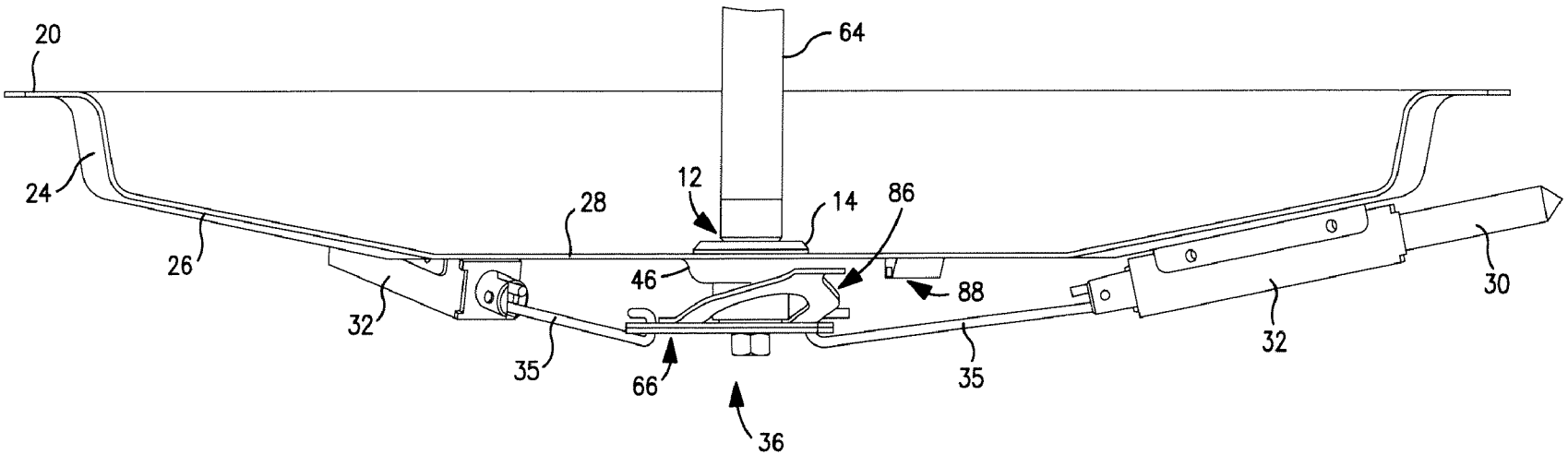
FIG. 8 is a cross-sectional view taken along line 8-8 in FIG. 7.
Figure 9:
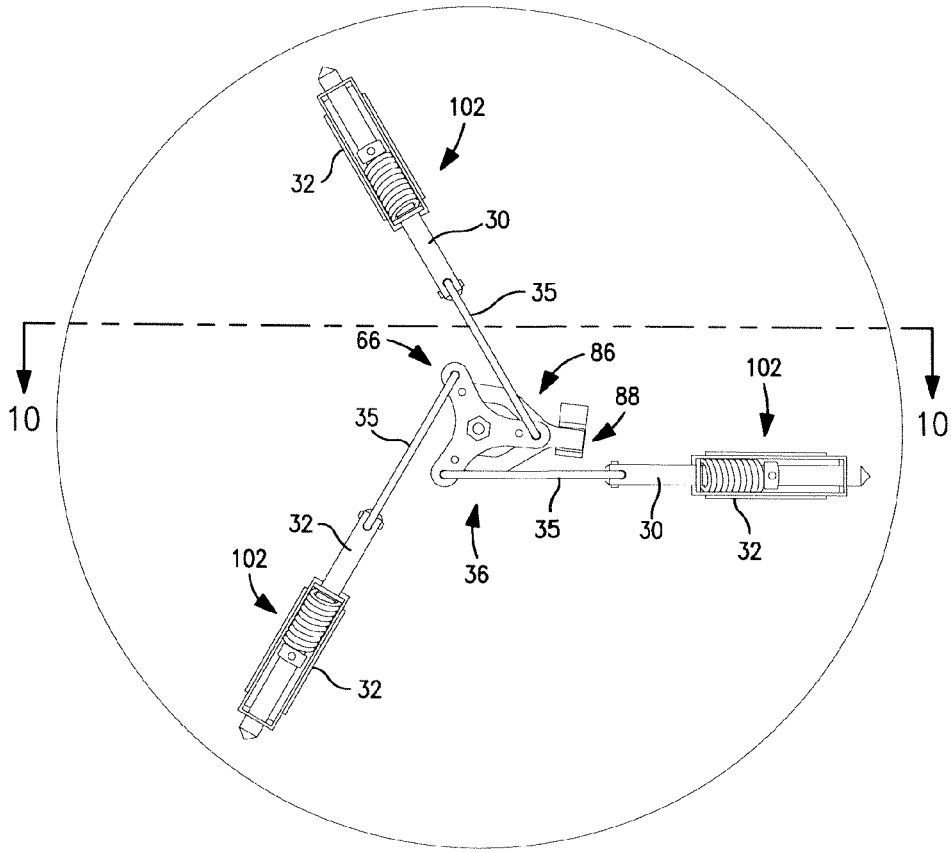
FIG. 9 is a bottom plan view of the manhole security device of FIG. 2 in an unlocked position.
Figure 10:
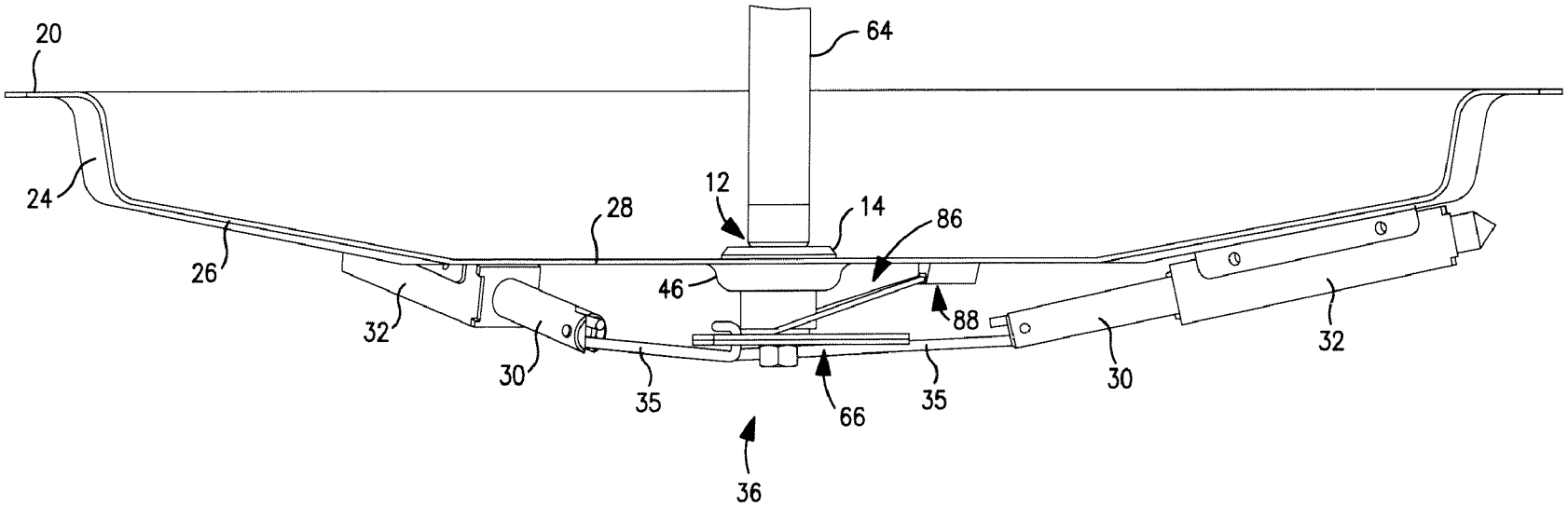
FIG. 10 is a cross-sectional view taken along line 10-10 in FIG. 9.

Turning now to FIGS. 7-10, the locking pin actuator 66 of the locking mechanism 36 is rotatable due to its keyed attachment to the pin 40. Rotation of the locking pin actuator 66 initiates sliding movement of the locking pins 30 through the locking pin mounts 32. FIGS. 7 and 8 illustrate a locking rotational position of the locking pin actuator 66 wherein the locking pins 30 are extended to a locked position for engagement with the manhole frame 4. FIGS. 9 and 10 illustrate an unlocking rotational position of the locking pin actuator 66 wherein the locking pins 30 are retracted to an unlocked position in which the locking pins are disengaged from the manhole frame 4. As shown in FIGS. 8 and 10, rotation of the locking pin actuator 66 is effected by rotating the security key 64 (referenced above in connection with FIG. 5B) while it engages the security lock 12 on the pin 40. To activate the locking mechanism 36 from the locking position (see FIG. 7) to the unlocking position (see FIG. 9), the locking pin actuator 66 must be rotated clockwise with respect to the reader. Insofar as FIGS. 7 and 9 depict the underside of the pan 10, it will be appreciated that a counterclockwise rotation of the security key 64 will be required to unlock the security device 8 when it is installed in the manner shown in FIG. 2.

Figure 11:
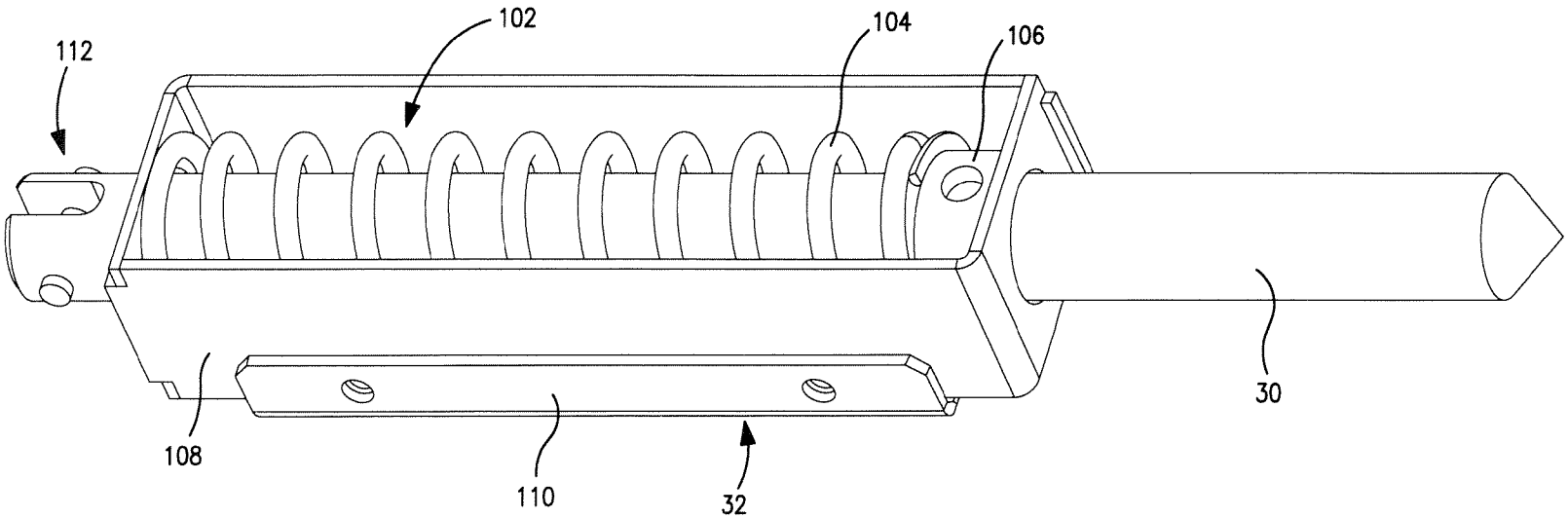
FIG. 11 is a perspective view of a biasing mechanism of the manhole security device of FIG. 2 in a first biasing position.
Figure 12:
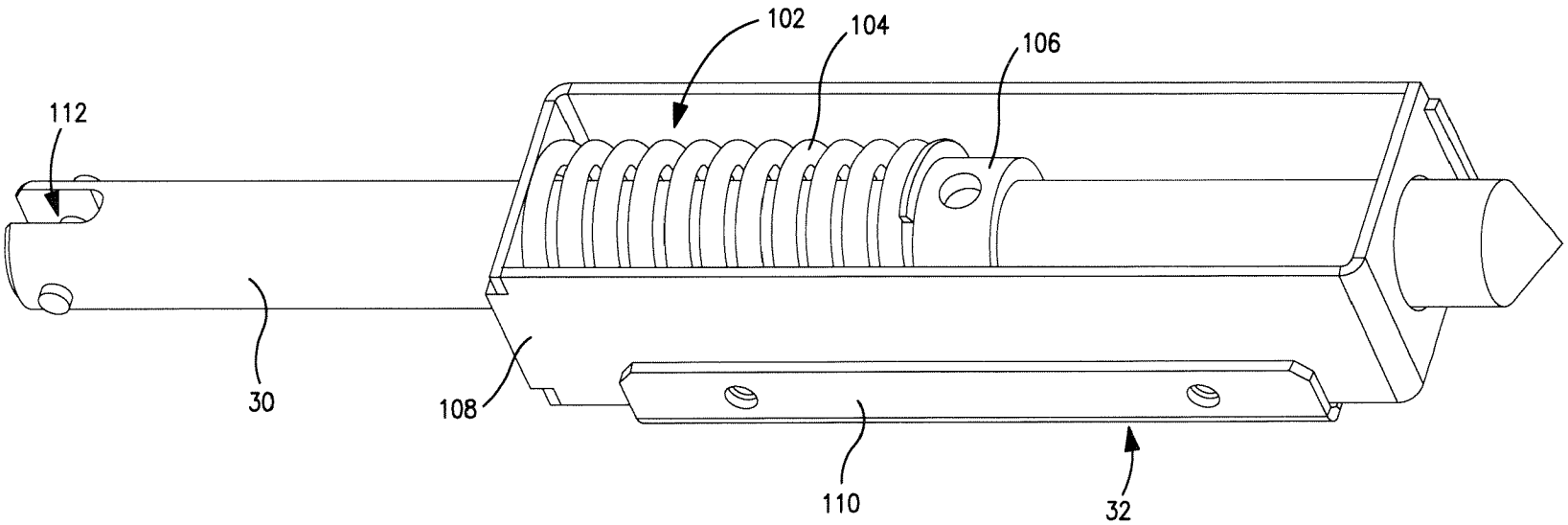
FIG. 12 is a perspective view of a biasing mechanism of the manhole security device of FIG. 2 in a second biasing position.

With additional reference to FIGS. 11 and 12, a biasing mechanism 102 is associated with each of the locking pin mounts 32 in order to bias the locking pins 30 to their extended locked position. The biasing mechanisms 102 can be implemented using coil springs 104 that are disposed in the locking pin mounts 32 and mounted to the locking pins 30, which extend axially therethrough. One end of each coil spring 104 bears against a stop member 106 that can be secured to the locking pin using a set screw (not shown) or the like. The other end of each coil spring 104 bears against the end wall of a rectangular box frame member 108 that forms part of the locking pin mount 32. FIG. 11 shows one of the coil springs 104 in a minimally compressed condition in which an associated locking pin 30 is extended to its locked position. FIG. 12 shows one of the coil springs 104 in more substantially compressed condition in which the associated locking pin 30 is retracted to its unlocked position. As also shown in FIGS. 11 and 12, each locking pin mount 32 may further include a U-shaped channel member 110 that can be welded or otherwise affixed to the pan 10. The channel member 110 may be secured to the box frame member 108 using suitable fasteners (not shown). FIGS. 11 and 12 further illustrate pin connections 112 that may be used to pivotally attach the locking pins 30 to the link members 35.

Figure 13:
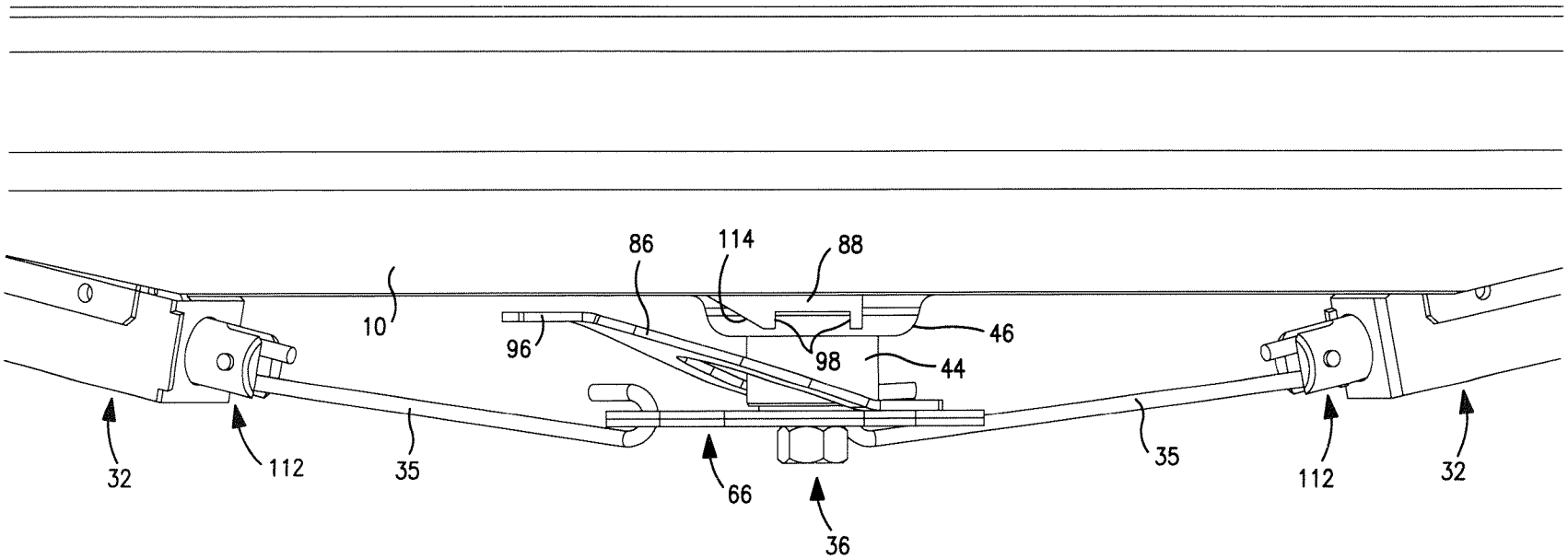
FIG. 13 is a side view of a locking mechanism of the manhole security device of FIG. 2 prior to a latching member engaging a latch that retains the security device in an unlocked position.
Figure 14:
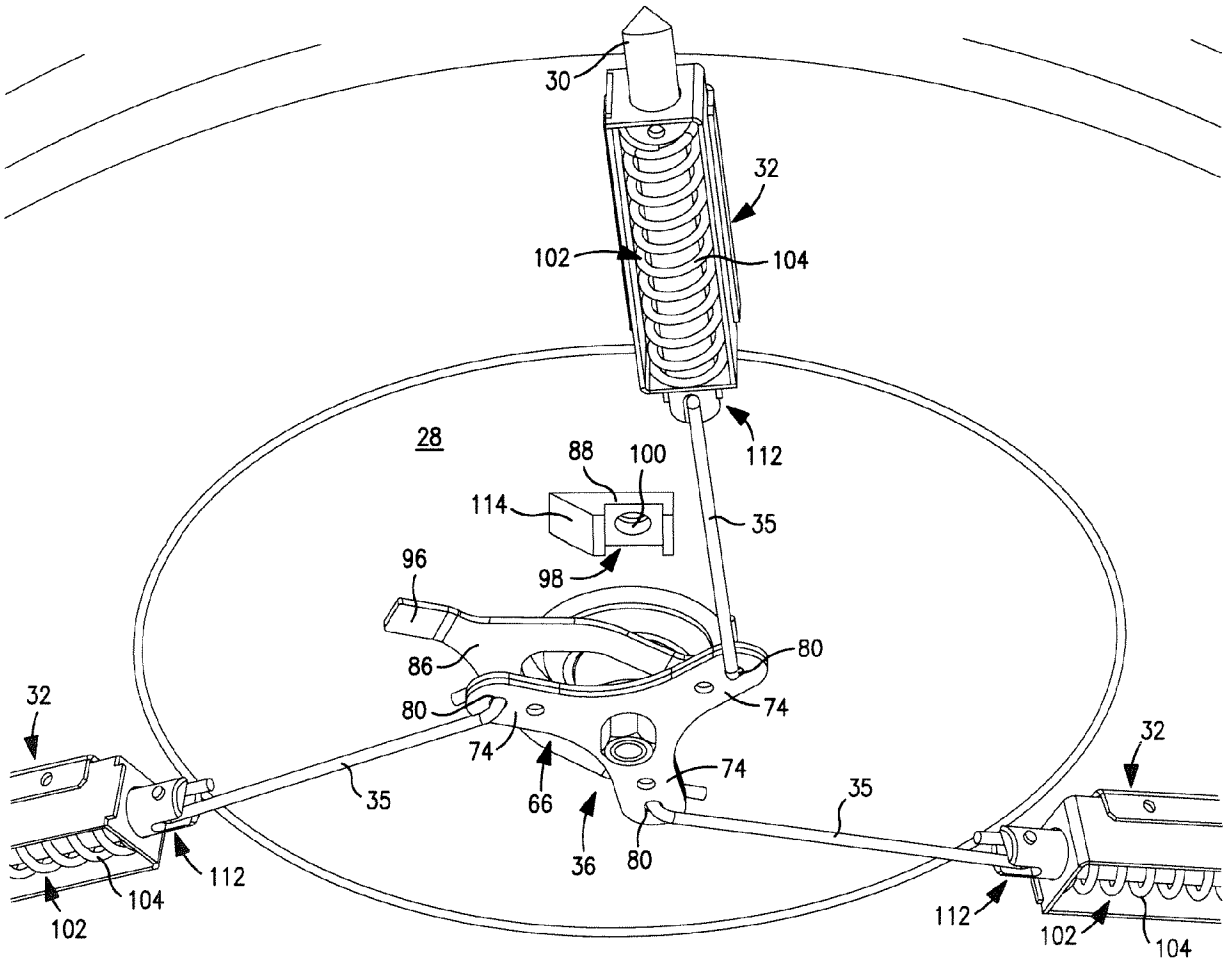
FIG. 14 is a perspective view of a locking mechanism of the manhole security device of FIG. 2 prior to a latching member engaging a latch that retains the security device in an unlocked position.

Turning now to FIGS. 13-16, the operation of the locking pin actuator 66 and the latching member 86 will be described in more detail. In FIGS. 13 and 14, the locking mechanism 36 is rotated to its locking position due to the spring forces of the biasing mechanisms 102. These spring forces, which result from the coil springs 104 being slightly compressed, urge the locking pins 30 to their extended locked positions. Due to the pivotal connections 112, the locking pins 30 pull the link members 35 with them as they extend. Because the link members 35 are attached to the apertures 80 in the arms 74 of the locking pin actuator 66, the locking pin actuator rotates counterclockwise to its locking position. It will also be seen in FIGS. 13 and 14 that the latching member 86, whose yoke portion is carried by two arms 74 of the locking pin actuator 66, will be operatively driven to an unlatched position. In this position, the latching tab 96 is disengaged from the latch channel 98 of the latch 88.

Figure 15:
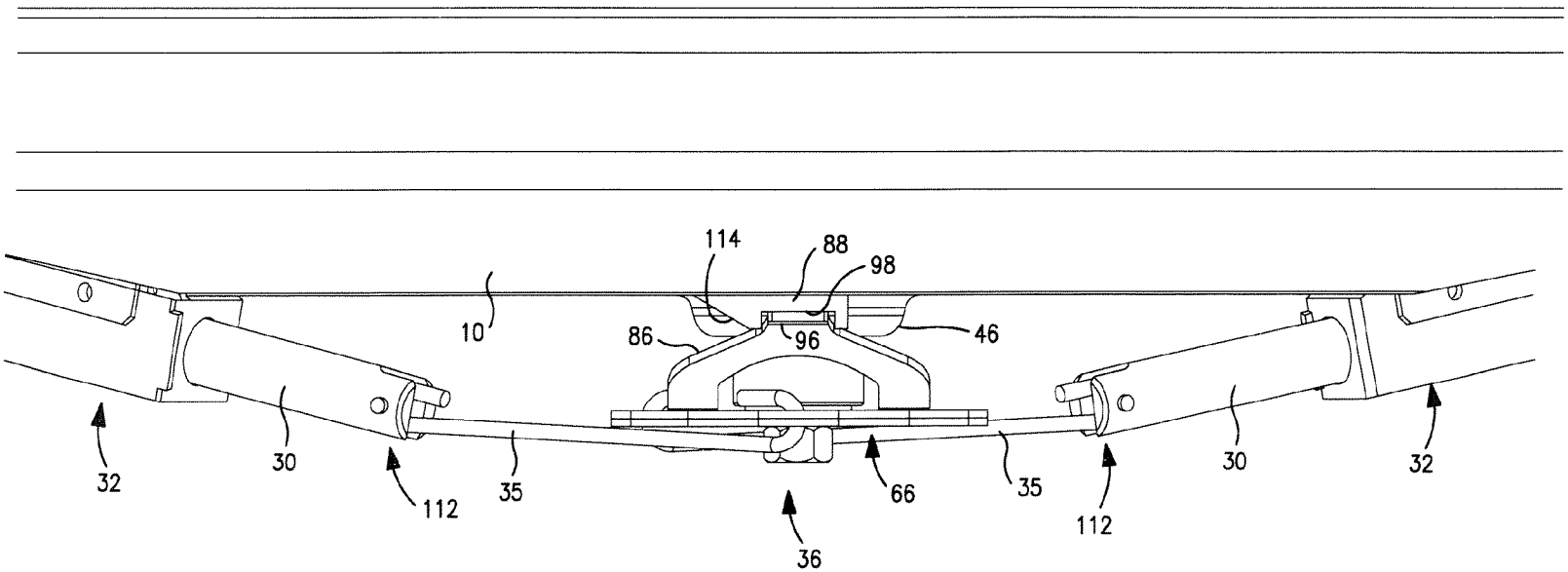
FIG. 15 is a side view of a locking mechanism of the manhole security device of FIG. 2 subsequent to a latching member engaging a latch that retains the security device in an unlocked position.
Figure 16:
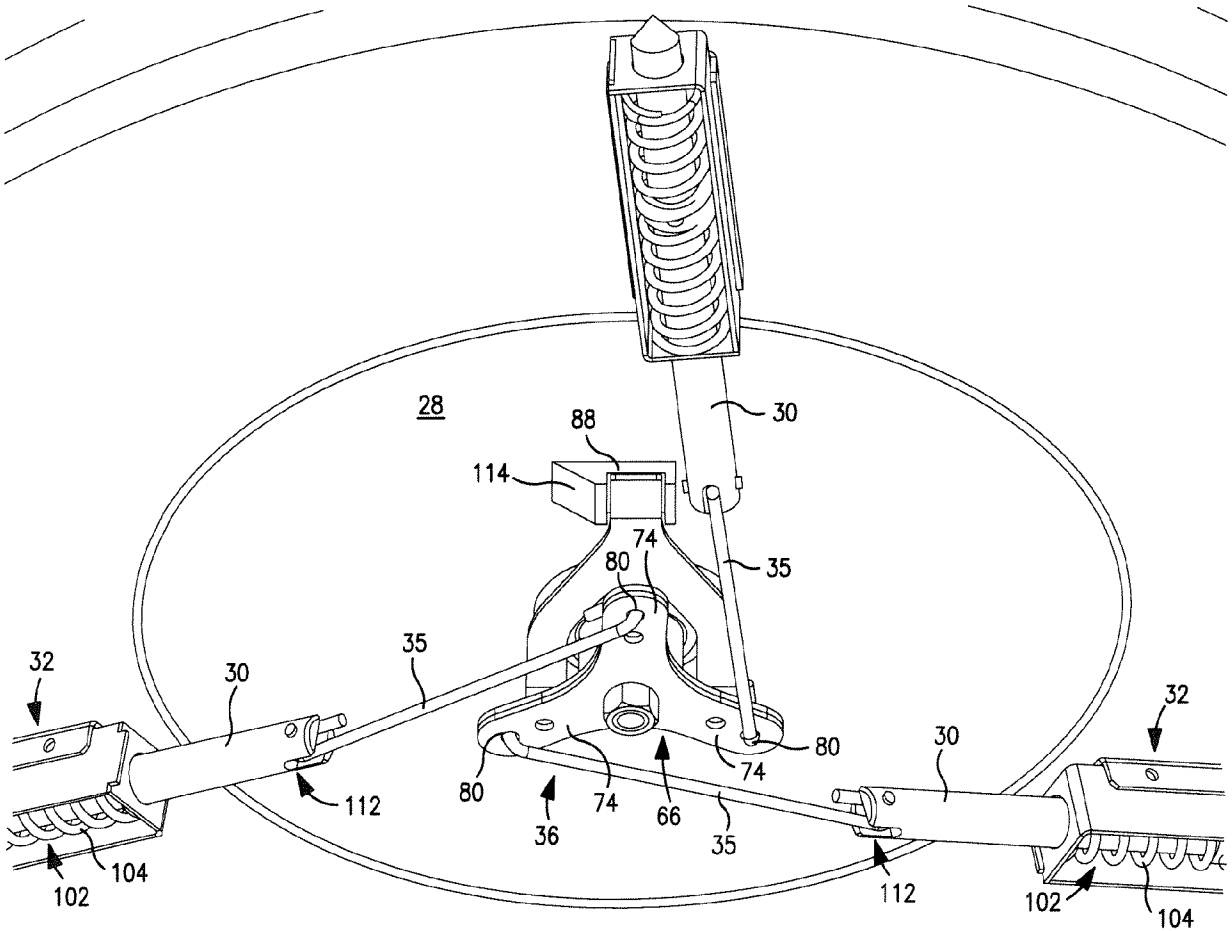
FIG. 16 is a perspective view of a locking mechanism of the manhole security device of FIG. 2 subsequent to a latching member engaging a latch that retains the security device in an unlocked position.

When it is desired to disengage the security device 8 from the manhole frame 4, the locking mechanism 36 is rotated clockwise with respect to the reader in FIG. 14. This rotates the locking pin actuator 66 and causes its arms 74 to pull the link members 35 away from the locking pin mounts 32, which retracts the locking pins 30 against the spring forces of the biasing mechanisms 102. The rotation of the locking pin actuator 66 also operatively drives the latching member 86 in the clockwise direction, such that its locking tab 96 moves toward the latch 88. As can be seen in FIG. 13, the latching member 86 is formed to extend upwardly from the two points of attachment with the locking pin actuator 66. This upward disposition of the latching member 86 positions the locking tab 96 in a horizontal plane that intersects the surface of a ramp 114 of the latch 88. As the latching member 86 rotates with the locking pin actuator 66, the locking tab 96 moves horizontally toward the ramp 114. When the locking tab 96 engages the ramp 114, the yoke portion of the latching member 86 will bend elastically, causing the locking tab to displace downwardly as it rides up the surface of the ramp. As the latching member 86 continues to rotate, the locking tab 96 eventually clears the ramp 114 and snaps into locking engagement with the latch channel 98 due to the yoke portion of the latching member returning to its undeformed position. This condition is shown in FIGS. 15 and 16. In the illustrated configuration, the latch 88 retains the latching member 86 against counter-rotation, which in turn maintains the locking mechanism 36 in the locking position. This means that the security key 64 can be disengaged from the security lock 12 and the security device 8 can be removed from the manhole frame 4 and placed on the ground. Although not shown, a handle or strap may be attached to the upper side of the pan 10 to facilitate its removal from the manhole frame 4.

The latch 88 is designed with a quick release feature that allows the latching member 86 to be released once the security device 8 is ready to be re-secured to the manhole frame 4. In particular, the aperture 100 in the latch 88 in combination with the aperture 16 in the pan 10 (see FIG. 6) accommodates a small diameter tool (not shown) that can be used to downwardly deflect the latching member 86 and thereby pop the locking tab 96 out of engagement with the latch channel 98. Due to the relatively large spring biasing forces imparted by the biasing mechanisms 102 when the locking mechanism 36 is in the unlocking position, the locking mechanism will snap back to its default locking position as soon as the locking tab 96 clears the latch channel 98.

Figure 17:
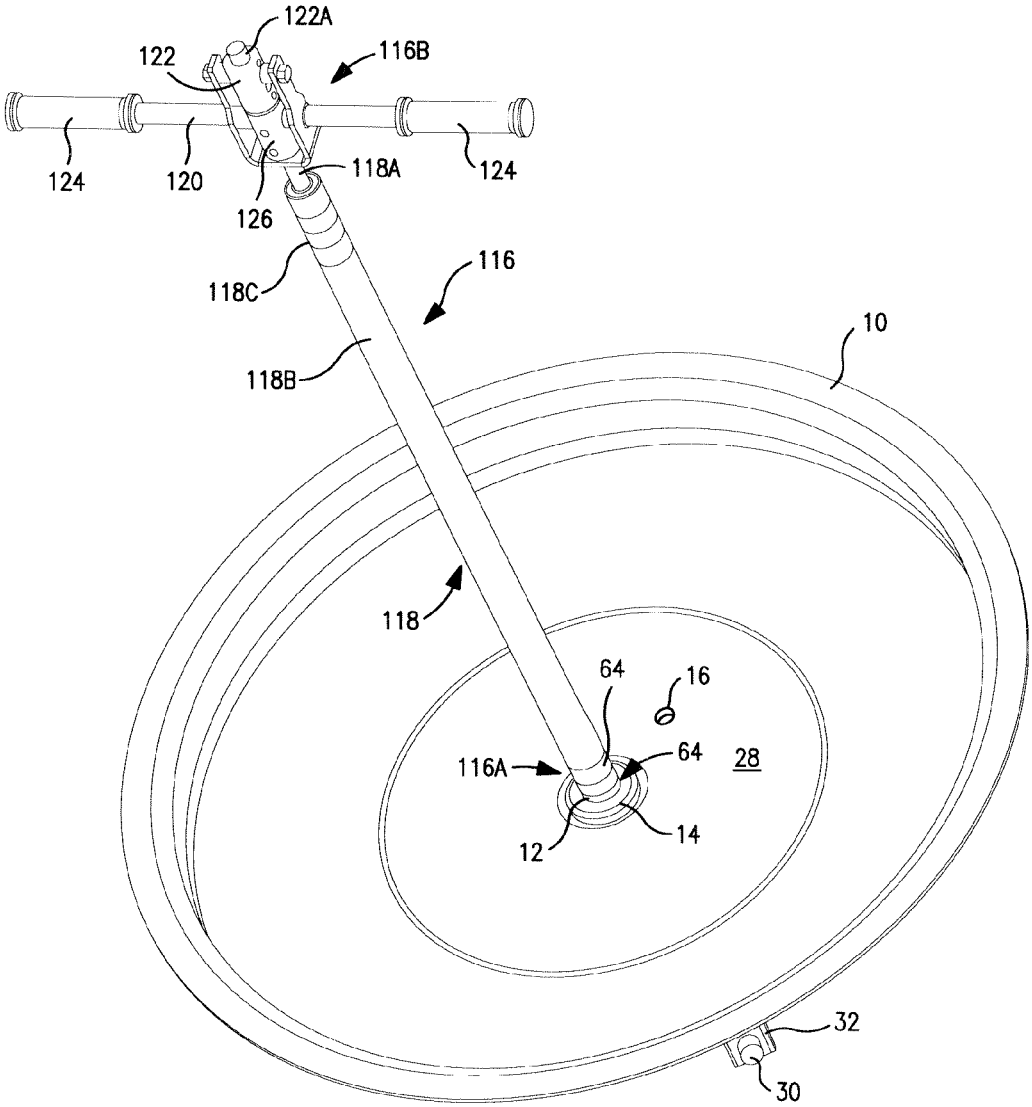
FIG. 17 is a perspective view of the manhole security device of FIG. 2 being operated by the key end of a security key tool.
Figure 18:
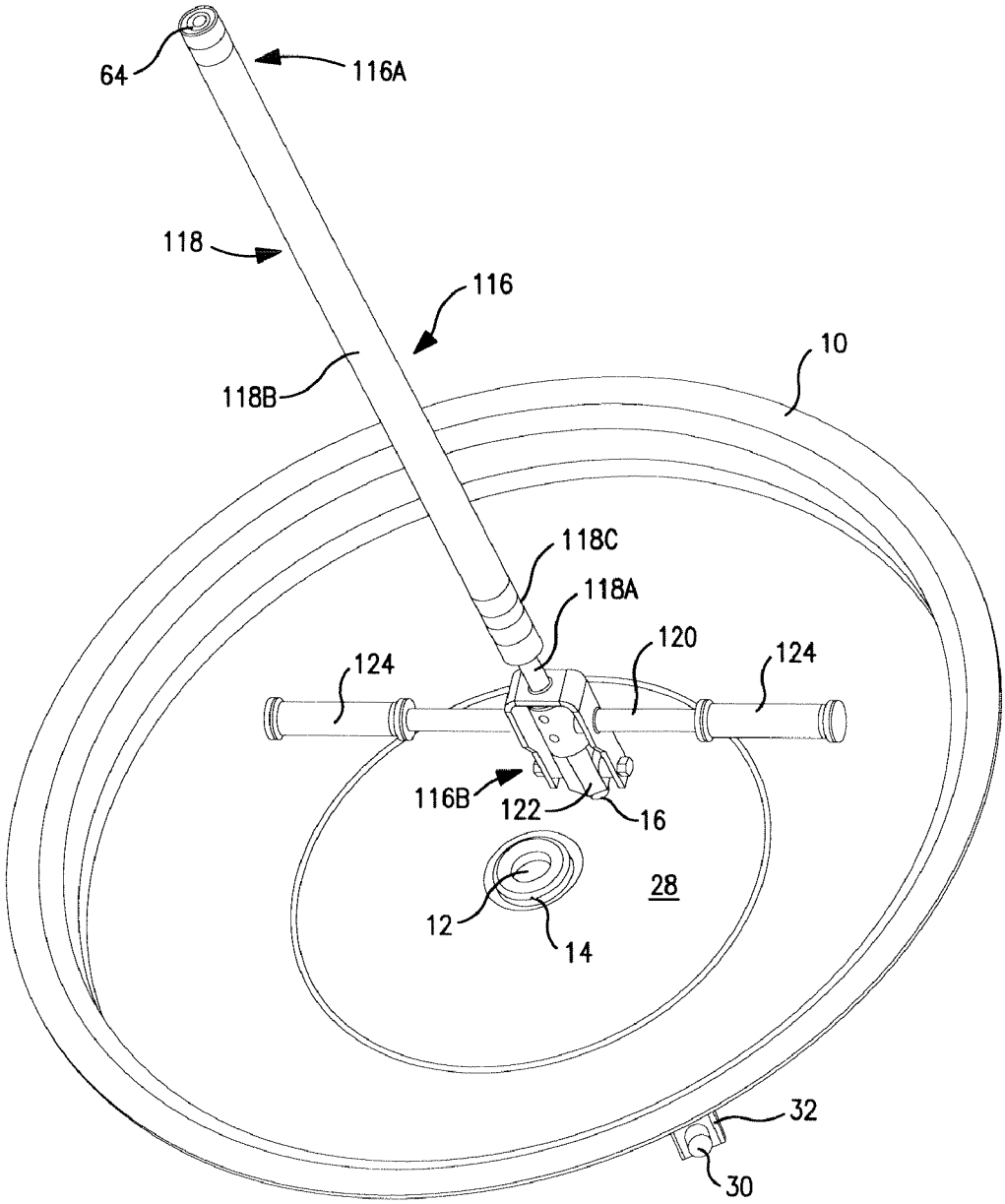
FIG. 18 is a perspective view of the manhole security device of FIG. 2 being operated by the tool end of the security key tool of FIG. 17.
Figure 19A:
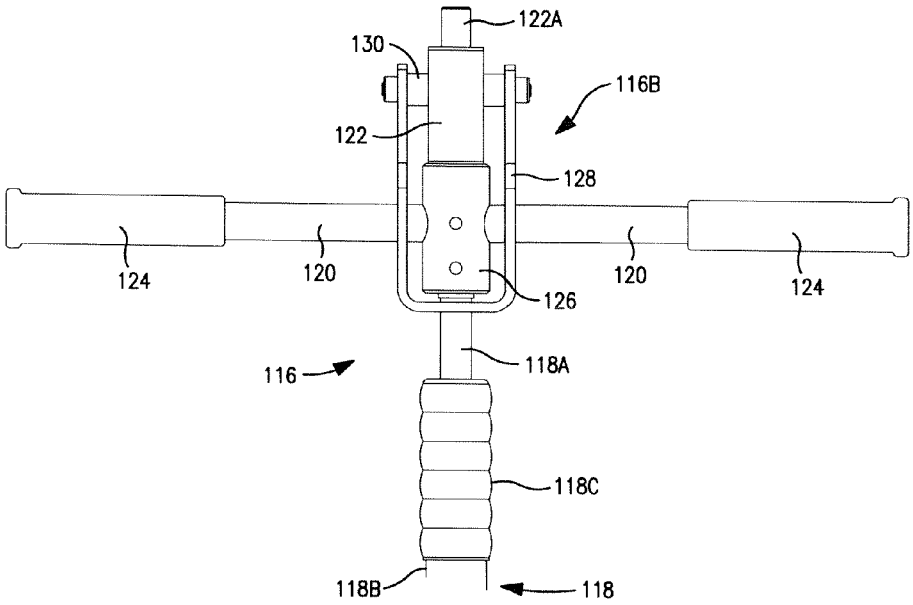
FIG. 19A is a side elevation view of the tool end of the security key tool of FIG. 17 showing a rotatable tool head in a first operative position presenting a latch-release tool.
Figure 19B:
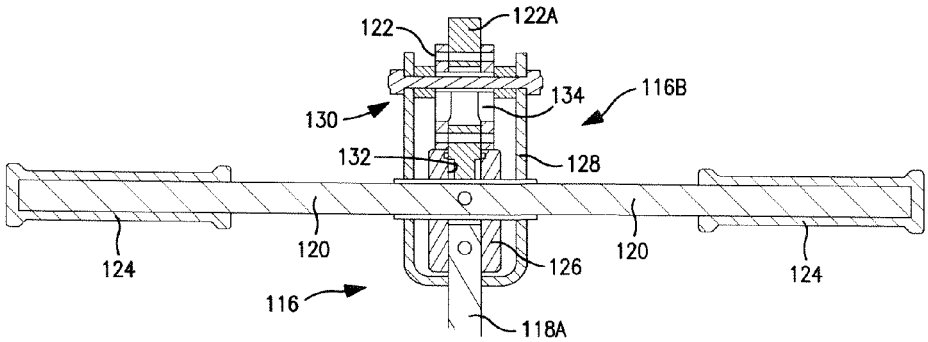
FIG. 19B is a cross-sectional view corresponding to the view of FIG. 19A.
Figure 19C:
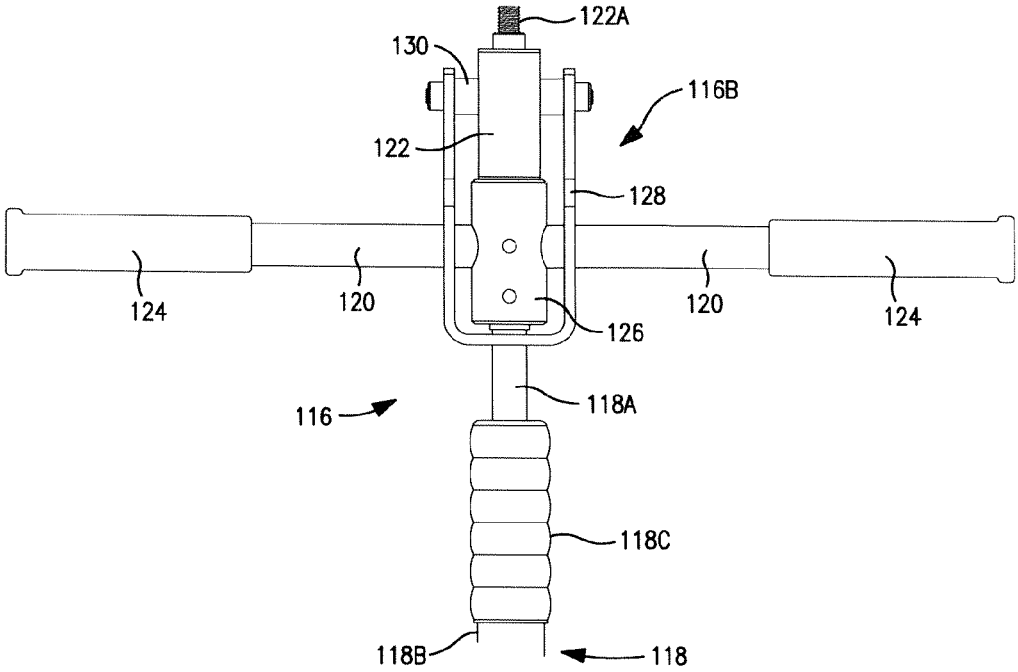
FIG. 19C is a side elevation view of the tool end of the security key tool of FIG. 17 showing the rotatable tool head in a second operative position presenting a lifting tool.
Figure 19D:
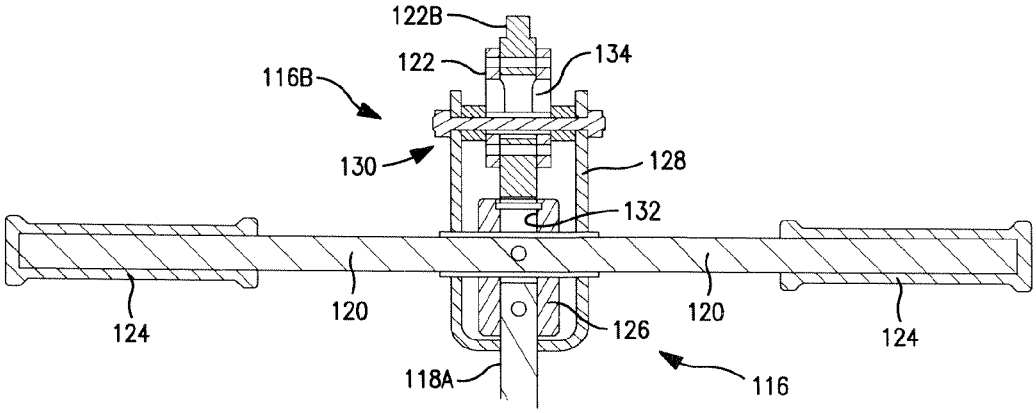
FIG. 19D is a cross-sectional view corresponding to the view of FIG. 19C.

Turning now to FIGS. 17 and 18, a security key tool 116 is shown that may be used to both unlock and lock the security device 8. The tool 116 is generally tee-shaped and includes a longitudinal body portion 118 and a transverse handle portion 120. The longitudinal portion 118 includes a solid inner rod member 118A and a tubular outer sleeve member 118B. Situated at one end of the sleeve member 118B is a grip 118C. The security key 64 is mounted to the rod member 118A at a key end 116A of the tool 116. As described in more detail below, the sleeve member 118B is slidably mounted on the rod member 118A and can be gripped at 118C to facilitate engagement of the security key 64 with the security lock 12. The rod member 118A also mounts a tool head 122 at a tool end 116B of the tool 116. The tool head 122 includes a small-diameter latch release tool 122A that is sized to extend through the access hole 16, as well as the latch channel aperture 100 (see FIG. 14) to engage the latching tab 96 of the latching member 86. The handle portion 120 of the tool 116 includes a pair of hand grips 124 that allow an operator to impart sufficient torque to the security key tool 64 to rotate the locking mechanism 36 against the spring biasing forces of the biasing mechanisms 102. The handle portion 120 is mounted to the longitudinal portion 118 via a generally tubular coupling member 126, which is affixed to the rod member 118A using appropriate fasteners. Additional details of the tool 116 are described in more detail below.

FIG. 17 shows the tool 116 being used to unlock the security device 8. In this position, the tool 116 is oriented so that the security key 64 engages the security lock 12 and the hand grips 124 are positioned where they can be easily gripped by the hands of an operator in order to rotate the security lock 12. Rotation of the security key 64 and the security lock 12 for one-quarter of a turn (90°) will be sufficient to unlock the security device 8 and engage the latching tab 96 in the latch channel 98 of the latch 88 (see FIG. 16). At this point, the security key 64 can be disengaged from the security lock 12, and the tool 116 can be set aside. FIG. 18 shows the tool 116 being used to re-lock the security device 8. In this position, the tool 116 is inverted and oriented so that the latch release tool 122A can be inserted into the access hole 16 in the pan 10, allowing it to extend through the latch channel aperture 100 and into engagement with the latching tab 96 of the latching member 86. In this orientation of the tool 116, the hand grips 124 will be positioned where they can be stepped on by the foot of an operator. Doing so will generate a downward force on the latch release tool 122A, causing it to pop the latching tab 96 out of engagement with the latch channel 98 (see FIG. 14). With the latching tab 96 thus disengaged, the pins 30 will be freely biased to their extended position so as to automatically lock the manhole security device 8 to the manhole frame 4.

FIGS. 19A-19D illustrate further details of the tool end 116B of the tool 116. As can be seen by comparing FIGS. 19A and 19B to FIGS. 19C and 19D, the tool head 122 may actually carry two tools rather than one. The first tool (see FIGS. 19A/19B) is the latch release tool 122A described above. The second tool (see FIGS. 19C/19D) is a threaded lifting tool 122B that may be used to engage and lift the security device 2 away from the manhole frame 4 after the security device is unlocked. The operation of the lifting tool 122B is described in more detail below. It allows the security device 2 to be constructed without a handle for those who desire this option. In order to select between the latch release tool 122A and the lifting tool 122B, the tool head 122 is pivotally mounted to a generally U-shaped bracket 128 whose base is mounted to the rod member 118A using appropriate fasteners. A pivot post assembly 130 mounted to the arms of the U-shaped bracket 128 provides the pivotal connection. When the tool head 122 is pivotally positioned to present one of the tools 122A or 122B, the other tool will be hidden from view. As can in FIGS. 19B and 19D, and also by momentarily jumping ahead to FIG. 20B, this results from the non-selected tool being captured in a short bore 132 formed in the adjacent face of the coupling member 126. As further shown in FIGS. 19B, 19D and 20B, an elongated slot 134 is formed in the tool head 122 where it receives the pivot post assembly 130. The slot 134 allows the tool head 122 to be pulled away from the coupling member 126 until the tool 122A or 122B that was captured in the bore 132 is free thereof (see FIG. 19D). In this clearance position, the tool head 122 may be freely pivoted about the pivot post assembly 130 in order to select the desired tool 122A or 122B (see FIG. 20B). Following this pivoting, the tool head 122 can be pushed back toward the coupling member 126 (by virtue of the slot 134) until the non-selected tool 122A or 122B is fully received in the bore 132.

Figure 20A:
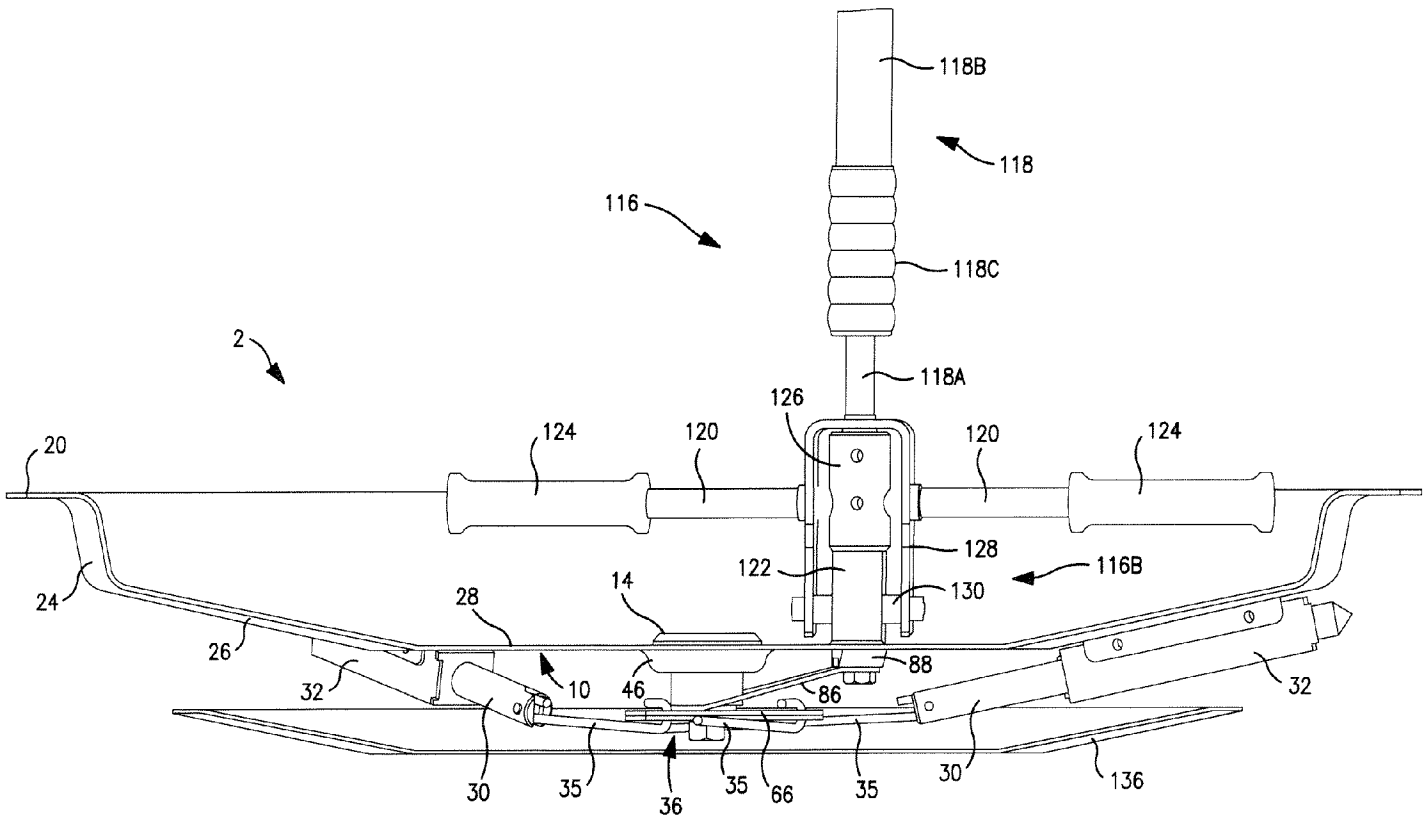
FIGS. 20A and 20B are side elevation views the security key tool of FIG. 17 respectively positioned to engage and lift a modified manhole security device away from the security manhole of FIG. 1, and showing a lower skid plate on the modified manhole security device.
Figure 20B:
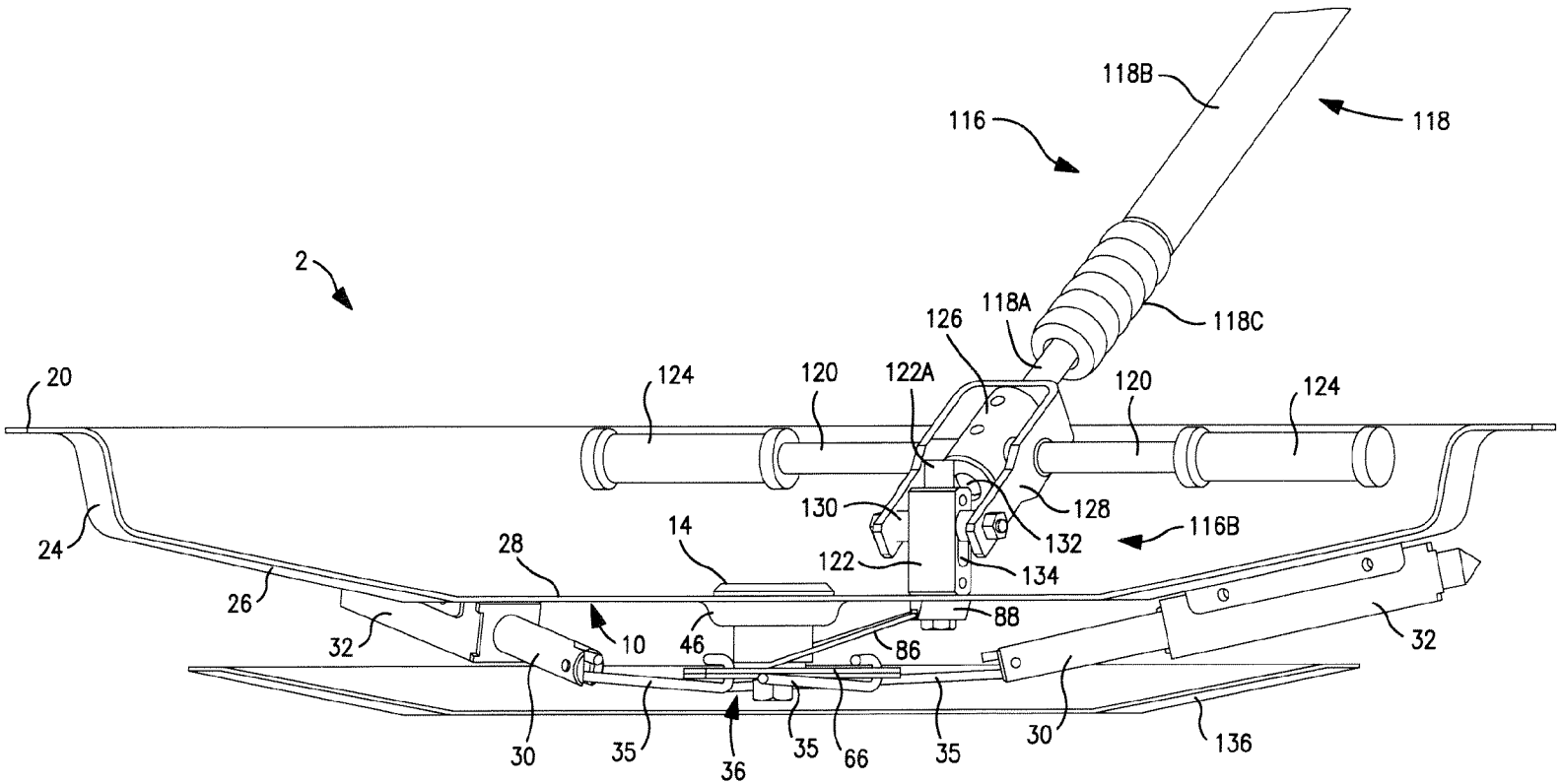

Turning now to FIGS. 20A and 20B, the operation of the tool 116 for lifting the security device 2 away from the manhole frame 4 will now be described. In FIGS. 20A and 20B, the security device 2 is the same as described above except that it further includes an optional lower skid plate 136 that allows the security device 2 to be dragged without damaging the components on the underside of the pan 10. Although not shown, the security device 2 has a further modification in that the aperture 100 formed in the latch channel 98 of the latch 88 (see FIG. 14) is formed with threads that engage the threads of the lifting tool 122B. FIG. 20A shows the tool 116 with its tool end 116B oriented downwardly and the lifting tool 122B threadably engaged to the latch channel aperture 100. Prior to this engagement, the tool 116 will have been used to unlock the security device 2 in the manner described above. Thus, the security device 2 will be ready for lifting away from the manhole frame 4. Importantly, the length of the lifting tool 122B is short enough that it will not contact the latching tab 96 (see FIG. 15) when the lifting tool is fully engaged in the latch channel aperture 100, thereby preventing inadvertent release of the locking mechanism 36 from its unlocking rotational position. The user may now apply a lifting force to the tool 116 by grabbing the sleeve member 118B near the tool's key end 116A. As shown in FIG. 20B, lifting the tool 116 pulls the pivot post assembly 130 upwardly through the slot 134 in the tool head 122 due to the latter being attached to the security device 2. This separates the latch release tool 122A from the bore 132 and allows the longitudinal portion 118 of the tool 116 to pivot relative to the tool head 122.

Figure 21:
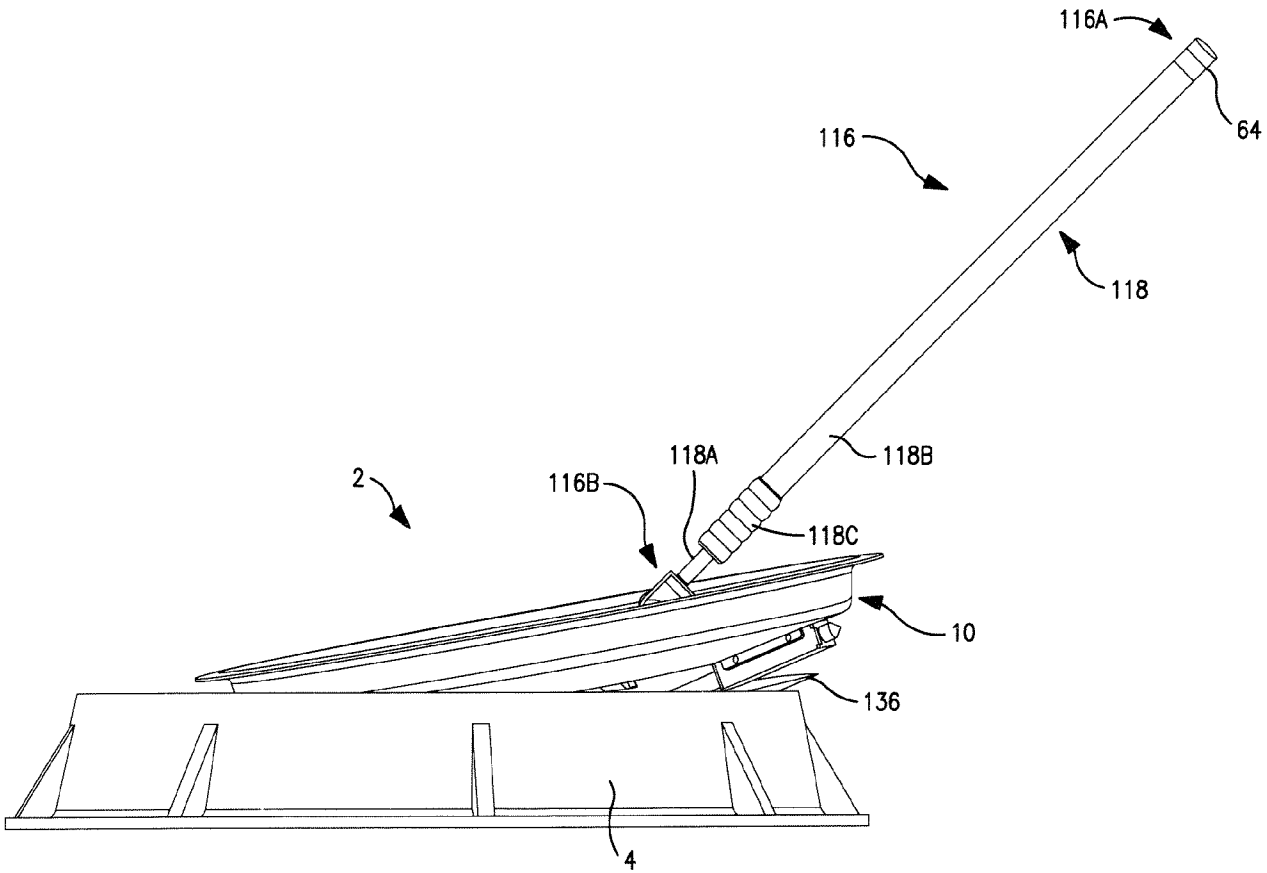
FIG. 21 is a side elevation view showing the security key tool of FIG. 17 while laterally sliding the modified manhole security device of FIGS. 20A and 20B away from the security manhole of FIG. 1.
Figure 22:
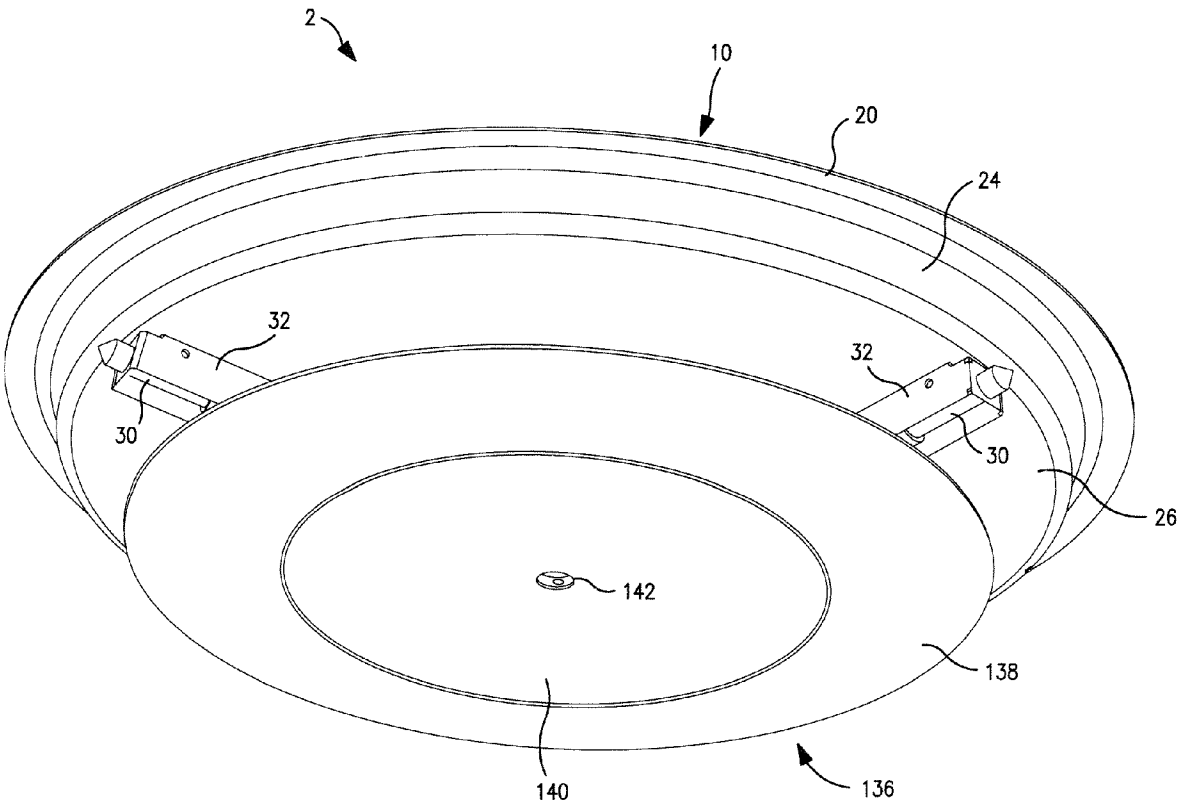
FIG. 22 is a perspective view showing the bottom of the skid plate of the modified manhole security device of FIGS. 20A and 20B.
Figure 23:
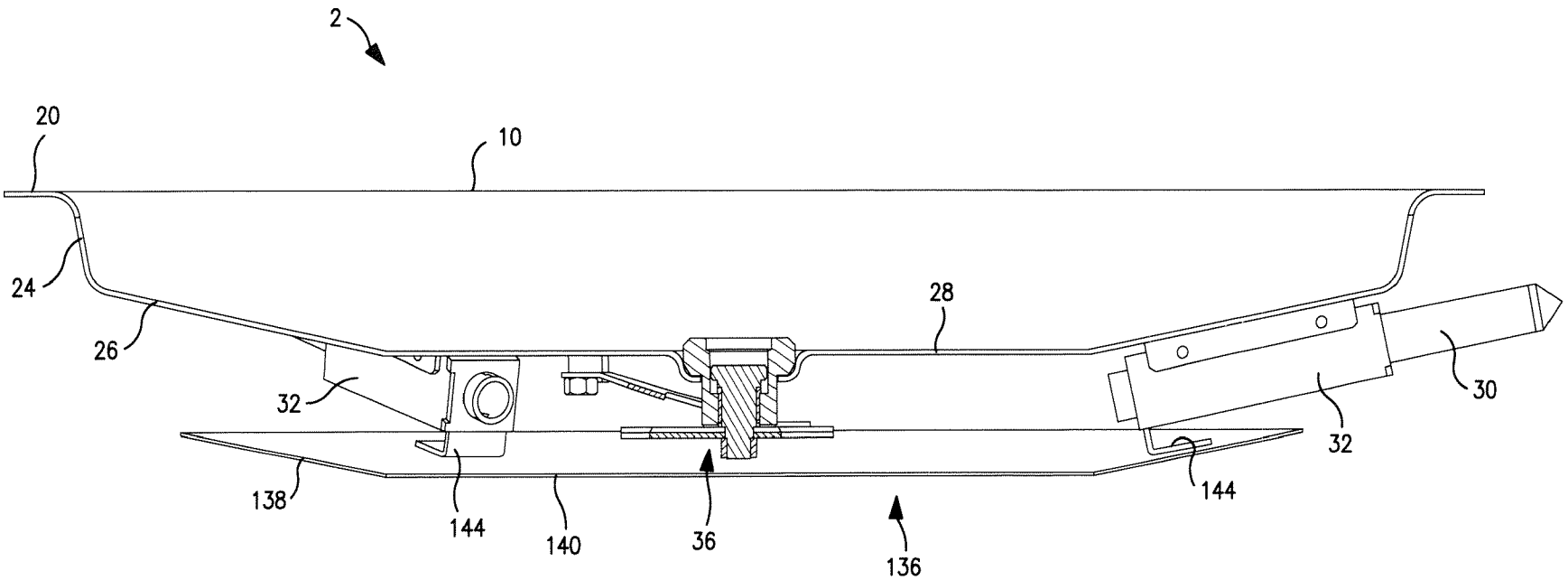
FIG. 23 is a cross-sectional centerline view of the modified manhole security device of FIGS. 20A and 20B showing an exemplary arrangement for attaching the skid plate.

As additionally shown in FIG. 21, the user may now pull on the tool 166 to drag the security device 2 away from the manhole frame 4 for temporary placement on an adjacent ground surface. As can be seen in FIG. 22, the skid plate 136 is designed to facilitate this removal operation while protecting the components on the underside of the security device's pan 10. To that end, the skid plate 136 includes an outer annular portion 138 that is angled upwardly away from a central disk portion 140 that is either flat or slightly conical in shape. As an additional feature, a drainage hole 142 may be formed at the center of the disk portion 140 to drain any moisture that may accumulate on the upper surface of the skid plate 136. FIG. 23 shows an exemplary arrangement for attaching the skid plate 136 to the security device 2 using brackets 144 extending from the locking pin mounts 32 that can be welded to the skid plate.

Figure 24A:
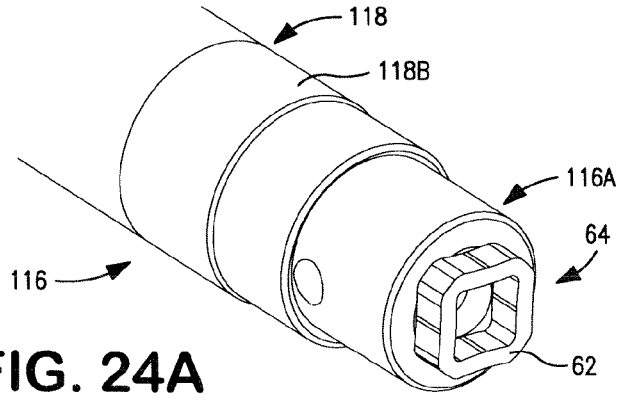
FIGS. 24A and 24B are enlarged perspective views showing the security key of FIG. 5B mounted at the key end of the security key tool of FIG. 17, and respectively showing a threaded sleeve member of the security key tool in a sleeve retracted position and a sleeve extended position.
Figure 24B:
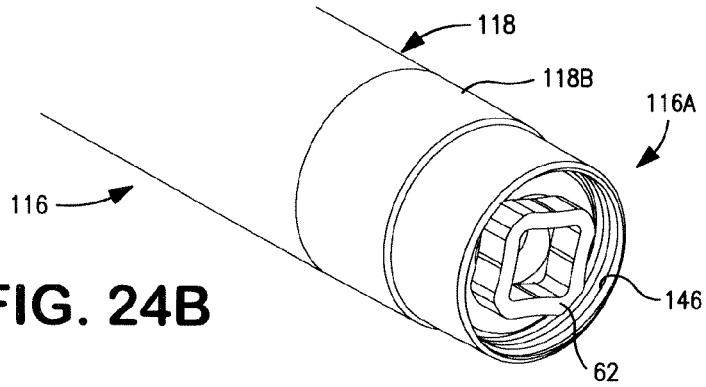
Figure 25:
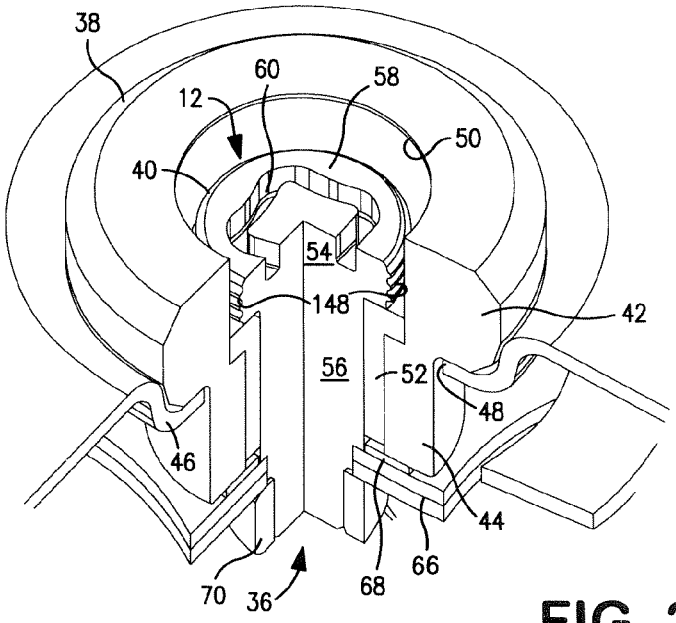
FIG. 25 is an enlarged perspective view showing the security lock of FIG. 5A.

Turning now to FIGS. 24A, 24B and 25, the key end 116A of the tool 116 can be configured with threads 146 on the inside surface of the tip of the sleeve member 118B. The threads 146 are adapted to engage corresponding threads 148 on the security lock 12. The engagement of the threads 146/148 interlocks the security key 64 to the security lock 12 to ensure there is affirmative locking engagement and prevent inadvertent separation of these components during the unlocking operation. This may be especially desirable in the event there is snow or ice buildup on top of the security lock 12. FIGS. 24A and 24B illustrate two positions of the sleeve member 118B that are relevant to the operation of the security key 64. In FIG. 24A, the sleeve member 118B is in a retracted position wherein the threads 146 are longitudinally recessed from the security key 64 and not exposed to view. In FIG. 24B, sleeve member 118B is in an extended position wherein the threads 146 are not recessed from the security key 64 and are fully exposed to view.

Figure 27:
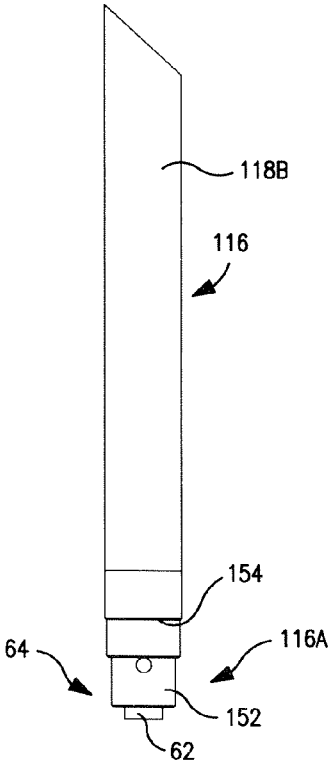
FIG. 27 is a side elevation view of the key end of the security key tool of FIG. 17 showing the sleeve retracted position.
Figure 26:
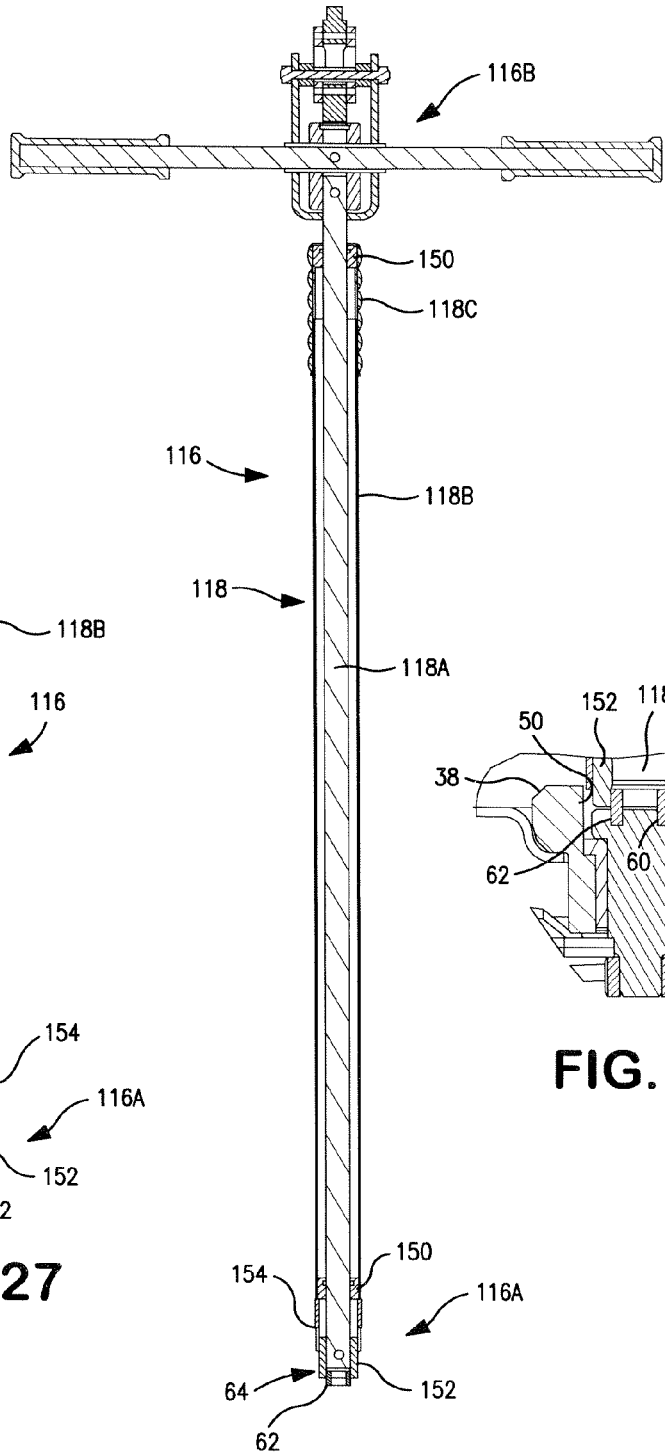
FIG. 26 is a cross-sectional centerline view of the security key tool of FIG. 17 showing the key end thereof in the sleeve retracted position.
Figure 28:
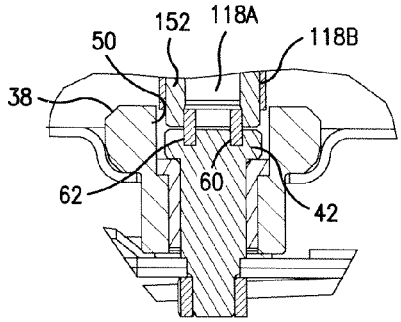
FIG. 28 is a cross-sectional view showing the security key of FIG. 5B operatively engaging the security lock of FIG. 5A with the key end of the security key tool in the sleeve retracted position.
Figure 30:
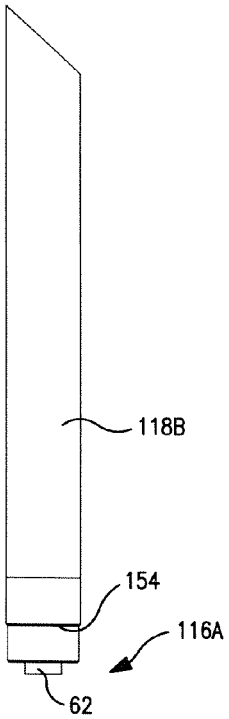
FIG. 30 is a side elevation view of the key end of the security key tool of FIG. 17 showing the sleeve extended position.
Figure 29:
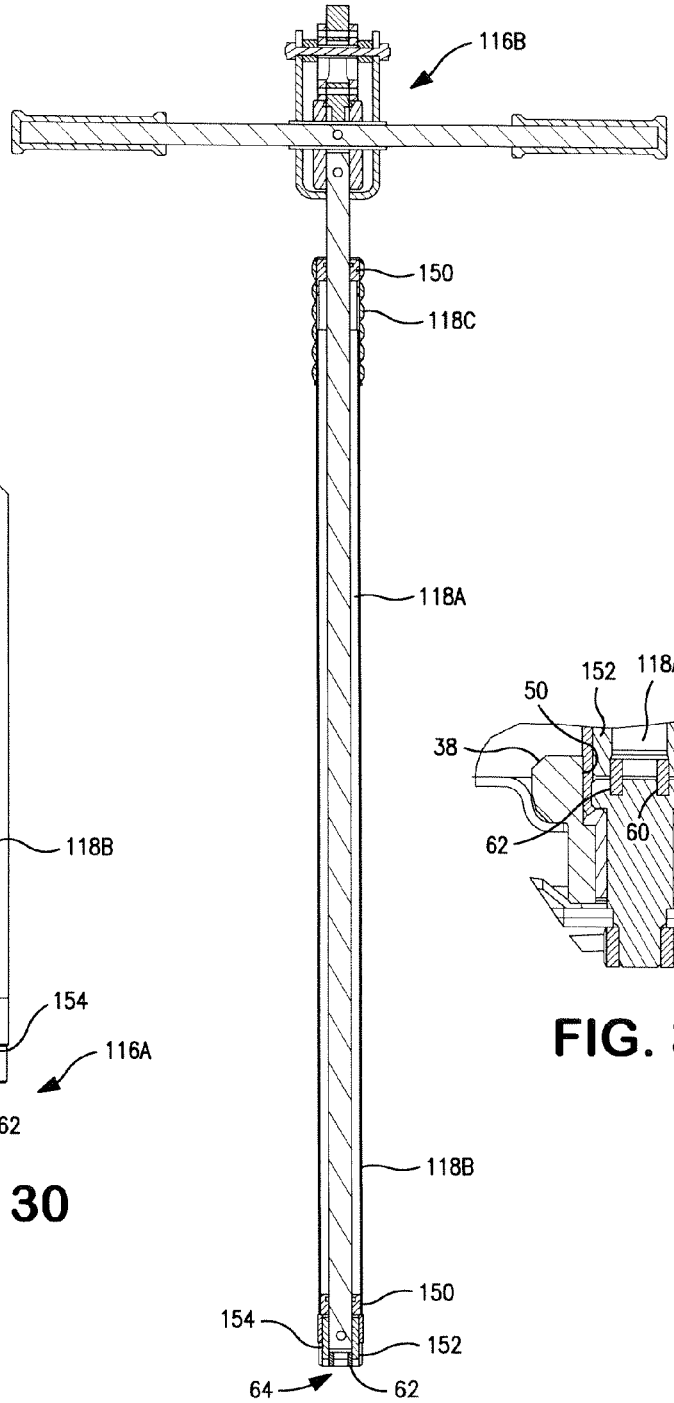
FIG. 29 is a cross-sectional centerline view of the security key tool of FIG. 17 showing the key end thereof in the sleeve extended position.

The significance of these positions may be appreciated by additionally considering FIGS. 26-28 and FIGS. 29-31. In FIGS. 26-28, the tool 116 is shown with the sleeve member 118B in the retracted position, while in FIGS. 29-31, the tool 116 is shown with the sleeve member in the extended position. The structure that allows the sleeve member 118B to slide on the rod member 118A can be seen in the cross-sectional views of FIGS. 26 and 29. As shown, the sleeve member 118B includes a pair of bushings 150 respectively situated at each end of the tubular portion of the sleeve member. The bushings 150 are preferably made from a low friction material, such as nylon or the like, so that they may freely slide on the rod member 118A. One of the bushings 150 is situated inside the grip 118C while the other bushing is spaced from a fitting 152 that provides a base portion of the security key 64. The fitting 152 is mounted to the rod member 118A by way of a suitable fastener (not shown).

Figure 31:
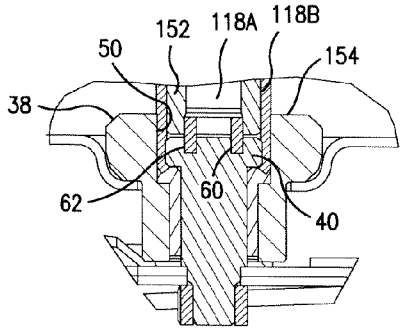
FIG. 31 is a cross-sectional view showing the security key of FIG. 5B operatively engaging the security lock of FIG. 5A with the key end of the security key tool in the sleeve extended position and with the sleeve threadably engaging a threaded portion of the security lock.

As can be seen in FIG. 28, the retracted position of the sleeve member 118B is assumed when it is desired to insert the security key 64 in the security lock 12. The grip 118C may be used to slide the sleeve member 118B to this position. The retraction of the sleeve member 118B away from the security key 64 gives the user a clear view of the security key as it is placed on the security lock 12, thereby allowing the curvilinear ridge 62 to be manipulated into mating engagement with the curvilinear groove 60. Once such engagement is achieved, the user may push down on the grip 118C to slide the sleeve member 118B downwardly until the threads 146 on the sleeve member come into contact with the threads 148 on the security lock 12. The sleeve member 118B is then rotated clockwise until the threads 146 and 148 are fully engaged. This full engagement position is shown in FIG. 31. Note that due to the relatively small clearance between the bore 50 of the fitting 38 and the pin 40 of the locking mechanism 36 that provides the security lock 12, a step 154 may be formed near the lower end of the sleeve member 118B to reduce the thickness of the sleeve member in this area. The tool 116 may then be rotated using the hand grips 124 without fear that the security key 64 will disengage from the security lock 12.

Figure 32A:
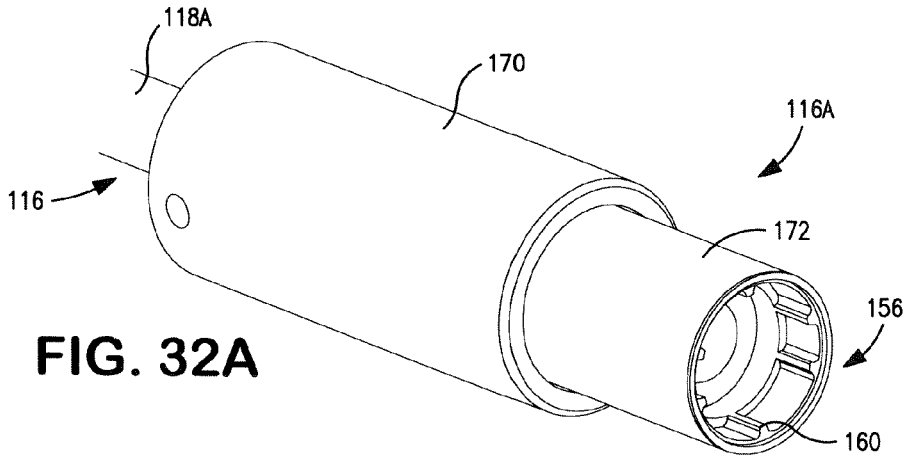
FIGS. 32A and 32B are enlarged perspective views showing an alternative security key mounted at the key end of an alternative security key tool, and respectively showing a key cover in a cover extended position and a cover retracted position.
Figure 32B:
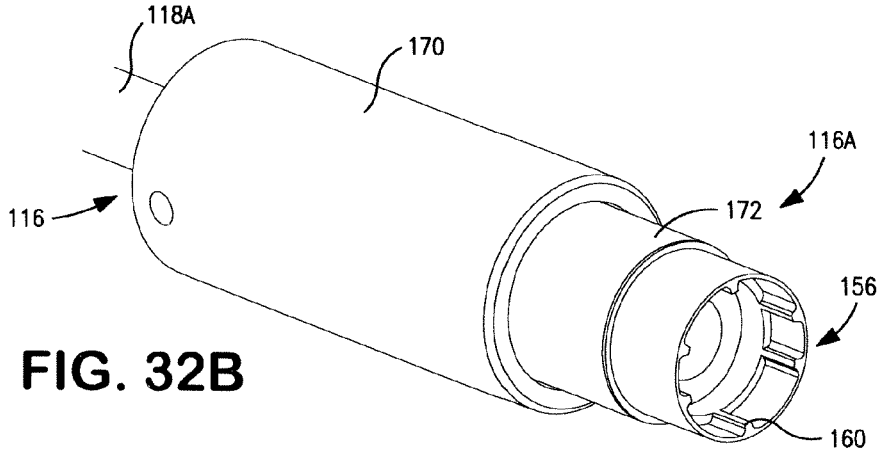
Figure 33:
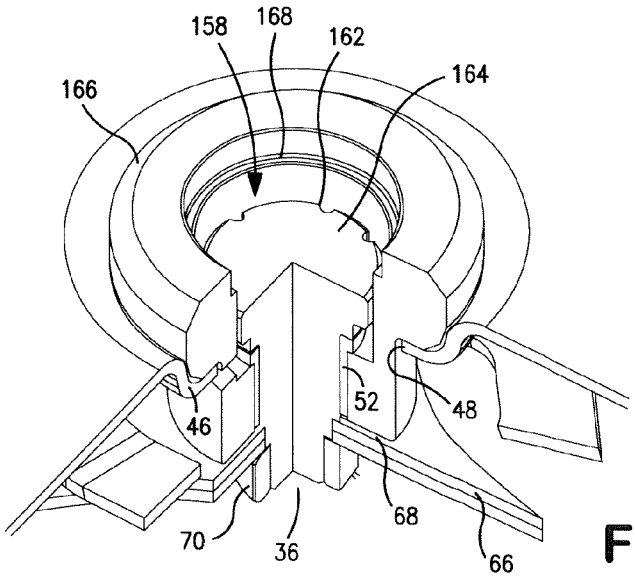
FIG. 33 is an enlarged perspective view showing an alternative security lock.

Turning now to FIGS. 32A, 32B and 33, the key end 116A of the tool 116 can be provided with an alternative security key 156 that is adapted to mate with an alternative security lock 158. The security key 156 is formed with a set of unevenly spaced longitudinal ridges 160 that mate with a set of corresponding longitudinal grooves 162 formed in the sides of an alternative pin 164 that replaces the original pin 40 of the locking mechanism 36. The locking mechanism 36 also includes an alternative fitting 166 that replaces the original fitting 38. The fitting 166 differs from the fitting 38 in that it has an annular step 168 spaced from the top surface thereof. The security key 156 extends from a housing 170 that is fixedly mounted to the rod member 118A by way of a suitable fastener (not shown). The housing 170 carries a key cover 172 that is slidable on the rod member 118A between an extended position in which it covers the key 156 (see FIG. 32A) and a retracted position in which the outer surface of the key 156 is exposed (see FIG. 32B). The key cover 172 protects the key 156 from damage when it is not in use. This protection is desirable because the walls of the key 156 where the ridges 160 are formed are relatively thin in order to pass through the small clearance between the pin 164 and interior bore of the fitting 166.

Figure 35:
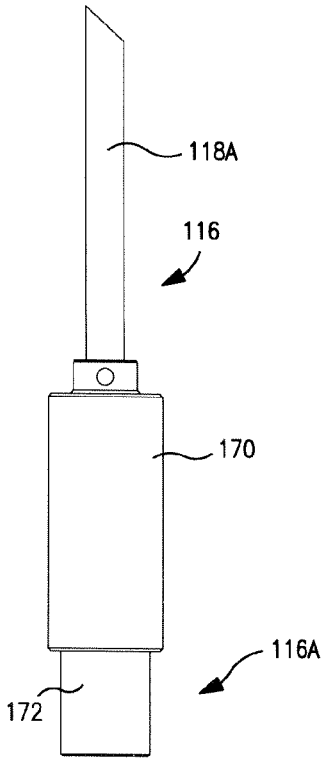
FIG. 35 is a side elevation view of the key end of the alternative security key tool of FIGS. 32A and 32B showing the cover extended position.
Figure 34:
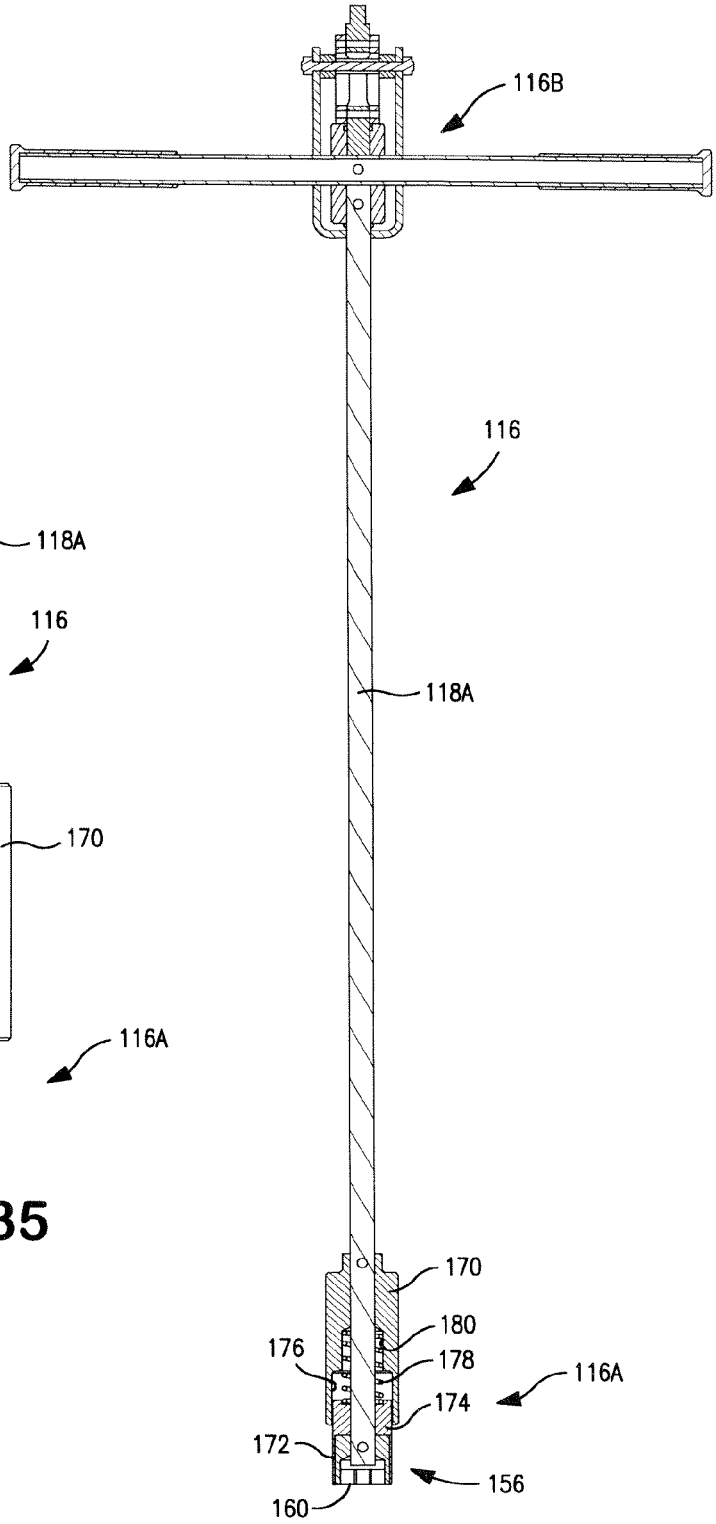
FIG. 34 is a cross-sectional centerline view of the alternative security key tool of FIGS. 32A and 32B showing the key end thereof in the cover extended position.
Figure 37:
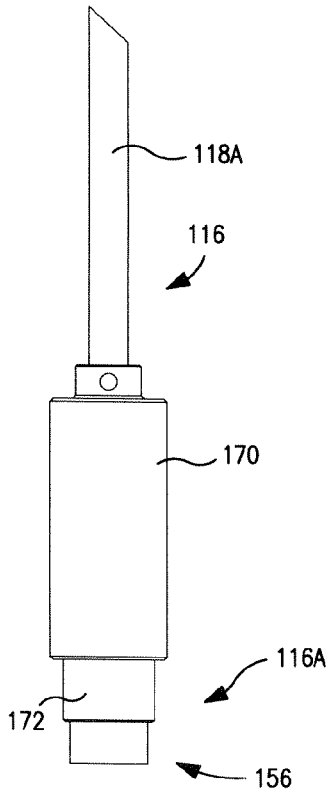
FIG. 37 is a side elevation view of the key end of the alternative security key tool of FIGS. 32A and 32B showing the cover retracted position.
Figure 36:
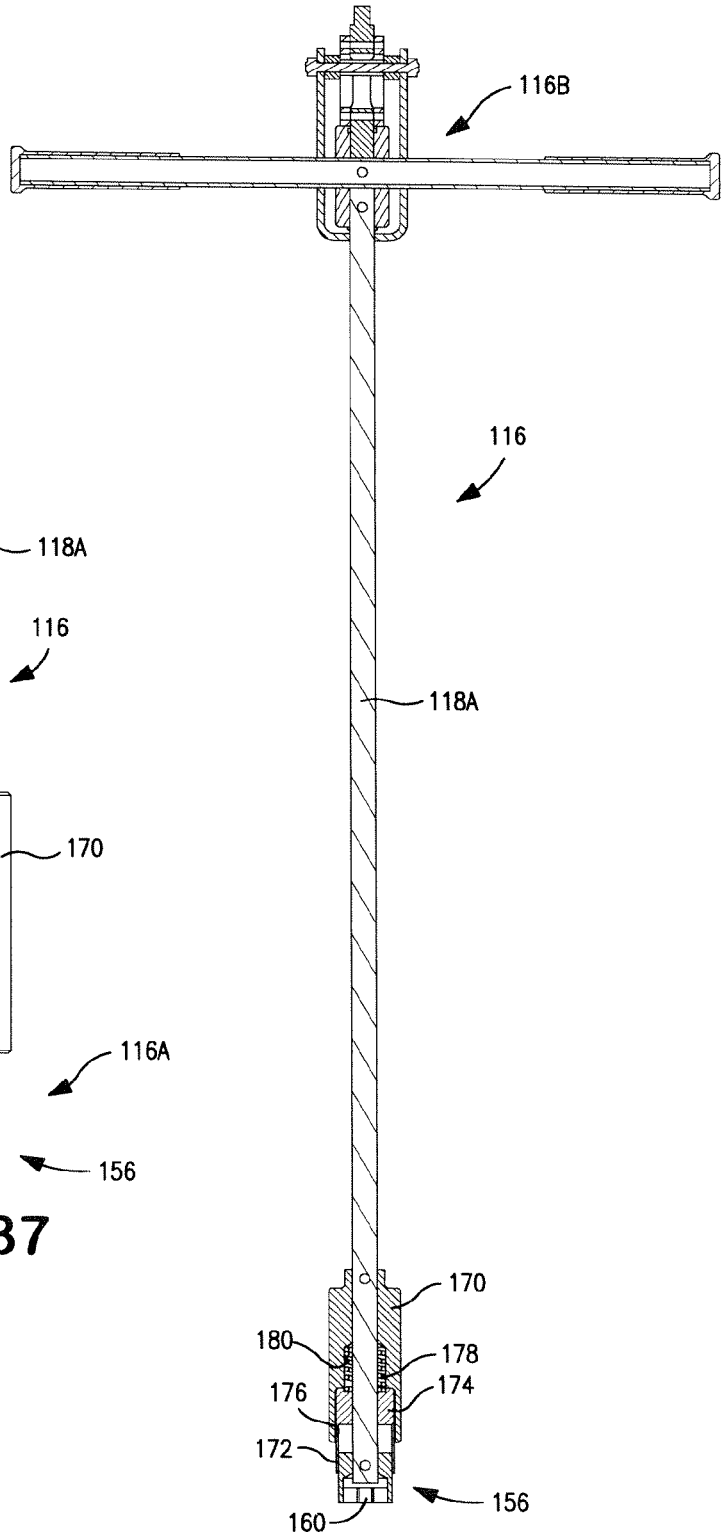
FIG. 36 is a cross-sectional centerline view of the alternative security key tool of FIGS. 32A and 32B showing the key end thereof in the cover retracted position.

The significance of the extended and retracted positions of the key cover 172 may be appreciated by additionally considering FIGS. 34-35 and FIGS. 36-37. In FIGS. 34-35, the tool 116 is shown with the key cover 172 in the extended position, while in FIGS. 36-37 the tool 116 is shown with the key cover in the retracted position. The structure that allows the key cover 172 to slide on the rod member 118A can be seen in the cross-sectional views of FIGS. 34 and 36. As shown, the key cover 172 includes a bushing portion 174 that slides on the rod member 118A and is received in a bore 176 formed in the housing 170. A biasing member, such as a spring 178, engages the bushing portion 174 and urges the key cover 172 toward its extended position. The other end of the spring 178 is captured in a second bore 180 situated at the base of the first bore 176.

The extended position of the key cover 172 is its normal position due to the biasing force of the spring 178. Referring back to FIGS. 32A, 32B and 33, when the security key 156 is inserted in the security lock 158 it may be rotated until the key ridges 160 align with the lock grooves 162. The security key 156 may then be longitudinally advanced into full engagement with the security lock 158. At some point during this longitudinal advancement, the end of the key cover 172 will contact the ridge 168 on the fitting 166, causing the key cover 172 to be pushed against the biasing force of the spring 178 to its retracted position. This allows the security key 156 to be advanced to into full locking engagement with the security key 158. Due to the relatively substantial longitudinal extent of this engagement, there is no need for the sleeve 118B described above with its threaded end portion. The security key 156 should remain engaged with the security lock 158 without any further interlocking of these components. Thus, the tool 116 may then be rotated using the hand grips 124 without fear that the security key 156 will disengage from the security lock 158.

Accordingly, a security key tool for a security device that secures a manhole access opening has been disclosed. While a exemplary embodiments have been shown and described, it should be apparent that many variations and alternative embodiments could be implemented in accordance with the teachings herein. It is understood, therefore, that the invention is not to be in any way limited except in accordance with the spirit of the appended claims and their equivalents.

What is claimed is:

1. A security key tool for a manhole security device, comprising:

a longitudinal body portion;

a handle portion;

a security key at a first end of said longitudinal portion adapted to engage a security lock on a manhole security device for actuating a locking mechanism on said security device to an unlocked position;

a latch release tool at a second end of said longitudinal portion adapted to release a latch on said manhole security device for actuating said locking mechanism to a locked position; and a lifting tool at said second end of said longitudinal portion adapted to engage and lift said security device away from a manhole frame after said security device is unlocked.

2. A security key tool in accordance with claim 1 wherein said handle portion is generally transverse to said longitudinal portion such that said security key tool is generally tee-shaped.

3. A security key tool in accordance with claim 1 wherein said handle portion is proximate to said second end of said longitudinal portion.

4. A security key tool in accordance with claim 1 wherein said latch release tool and said lifting tool are disposed on a tool head, and further wherein said lifting tool is adapted to engage said security device in a manner that provides a security feature whereby said latch cannot be released while said lifting tool is engaged to said security device.

5. A security key tool in accordance with claim 4 wherein said tool head is movable between a first position wherein said security key is presented for operation and a second position wherein said lifting tool is presented for operation.

6. A security key tool in accordance with claim 4 wherein said tool head is pivotable relative to said longitudinal portion to allow said longitudinal portion to be angled relative to said tool head when said lifting tool is engaged to lift said security device.

7. A security key tool in accordance with claim 1 wherein said security key comprises a curvilinear ridge adapted to engage a mating curvilinear groove formed on said security lock.

8. A security key tool in accordance with claim 7 wherein said security key tool comprises a sleeve having internal threads adapted to engage a threaded portion of said security lock to maintain operative engagement between said security key and said security lock, said sleeve being slidably positionable between an extended position wherein said sleeve surrounds said security key and a retracted position wherein said sleeve does not surround said security key.

9. A security key tool in accordance with claim 1 wherein said security key comprises unevenly spaced longitudinal ridges adapted to engage mating longitudinal grooves formed on said security lock.

10. A security key tool in accordance with claim 9 wherein said security key tool comprises a security key cover that is slidably positionable between an extended position wherein said cover protectively surrounds said security key and a retracted position wherein said sleeve does not surround said security key, and further wherein said cover is biased to said extended position.

11. A security key tool in combination with a manhole security device, said security key tool comprising:

a longitudinal body portion;

a handle portion;

a security key at a first end of said longitudinal portion adapted to engage a security lock on a manhole security device for actuating a locking mechanism on said security device to an unlocked position; and a latch release tool at a second end of said longitudinal portion adapted to release a latch on said manhole security device for actuating said locking mechanism to a locked position;

said manhole security device comprising:

a circular barrier adapted to rest on a manhole cover support flange of a manhole frame;

locking members on said barrier;

said locking members being movable between a locked position in which said locking members are adapted to engage said manhole frame and an unlocked position in which said locking members are not adapted to engage said manhole frame;

a biasing mechanism on said barrier adapted to bias each of said locking members to said locked position;

a rotatable locking mechanism on said barrier engaging said locking members and having a locking rotational position wherein said locking members are in said locked position and an unlocking rotational position wherein said locking members are in said unlocked position;

said locking mechanism having a security lock adapted to receive said security key as it applies a rotational torque to said locking mechanism; and a latch on said barrier adapted to releasably retain said locking mechanism in said unlocking rotational position without said security lock being engaged by said security key.

12. A security key tool in combination with a security device for securing a manhole access opening, said security key tool comprising:

a longitudinal body portion;

a handle portion;

a security key at a first end of said longitudinal portion adapted to engage a security lock on a manhole security device for actuating a locking mechanism on said security device to an unlocked position; and a latch release tool at a second end of said longitudinal portion adapted to release a latch on said manhole security device for actuating said locking mechanism to a locked position;

said manhole security device comprising:

a circular pan adapted to rest on a manhole cover support flange of a manhole frame;

locking pins mounted to a lower side of said pan;

said locking pins being slidable between an extended position in which said locking pins are adapted to engage said manhole frame and a retracted position in which said locking pins are not adapted to engage said manhole frame;

a spring mechanism adapted to bias each of said locking pins to said extended position;

a central aperture in said pan;

a fitting in said central aperture having a rotatable pin;

a locking pin actuator on said rotatable pin, said locking pin actuator engaging said locking pins and having a locking rotational position wherein said locking pins are in said extended position and an unlocking rotational position wherein said locking pins are in said retracted position;

said rotatable pin comprising a security lock adapted to receive a security key that applies a rotational torque to said locking actuator;

a latching member operatively driven by said rotatable pin; and a latch on said barrier adapted to releasably retain said latching member in said unlocking rotational position without said security lock being engaged by said security key tool.

13. A security key tool in combination with a manhole security device for securing a manhole access opening, said security key tool comprising:

a longitudinal body portion;

a handle portion;

a security key at a first end of said longitudinal portion adapted to engage a security lock on a manhole security device for actuating a locking mechanism on said security device to an unlocked position; and a latch release tool at a second end of said longitudinal portion adapted to release a latch on said manhole security device for actuating said locking mechanism to a locked position;

said manhole security device comprising:

a circular pan adapted to rest on a manhole cover support flange of a manhole frame;

said pan comprising a non-horizontal angled section;

three or more locking pins mounted to locking pin mounts on a lower side of said non-horizontal angled section of said barrier so as to extend upwardly in generally perpendicular alignment with an angled side-wall on said manhole frame;

said locking pins being slidable between an extended position in which said locking pins are adapted to engage said manhole frame and a retracted position in which said locking pins are not adapted to engage said manhole frame;

coil spring members disposed on said locking pins and engaging said locking member mounts to bias said locking pins to said extended position;

a central aperture in said pan;

a fitting in said central aperture having a rotatable pin;

a locking pin actuator comprising a central hub mounted on said rotatable pin and arm members connected to respective ones of said locking pins, said locking pin actuator having a locking rotational position wherein said locking pins are in said extended position and an unlocking rotational position wherein said locking pins are in said retracted position;

said rotatable pin comprising a security lock adapted to receive a security key that applies a rotational torque to said locking actuator;

a latching member operatively driven by said rotatable pin, said latching member comprising a yoke member attached to a pair of said locking pin actuator arm members;

a latch on said barrier adapted to releasably retain said latching member in said unlocking rotational position without said security lock being engaged by a security key tool;

said latch comprising a channel and a ramp on one side of said channel for guiding a latch-engaging portion of said yoke member into said channel as said rotatable pin is rotated to rotate said locking pin actuator from said locking rotational position to said unlocking rotational position;

said barrier comprising an aperture aligned with said latch channel to receive a tool adapted to displace said latch-engaging portion of said yoke member out of said channel so that said spring members may return said locking pins to said extended position; and said security key tool further including a lifting tool adapted to engage said aperture and lift said security device away from a manhole frame after said security device is unlocked, said lifting tool being adapted to engage said aperture in a manner that provides a security feature whereby said latch cannot be released while said lifting tool is engaged to said aperture.

14. A security key tool for a manhole security device, comprising:

a longitudinal body portion;

a transverse handle portion;

a security key at a first end of said longitudinal portion adapted to engage a security lock on a manhole security device for actuating a locking mechanism on said security device to an unlocked position;

said security key comprising a curvilinear ridge adapted to engage a mating curvilinear groove formed on said security lock;

a sleeve having internal threads adapted to engage a threaded portion of said security lock to maintain operative engagement between said security key and said security lock, said sleeve being slidably positionable between an extended position wherein said sleeve surrounds said security key and a retracted position wherein said sleeve does not surround said security key; and a latch release tool at a second end of said longitudinal portion adapted to release a latch on said manhole security device for actuating said locking mechanism to a locked position.

15. A security key tool in accordance with claim 14 wherein said latch release tool is disposed on a tool head that also includes a lifting tool adapted to engage and lift said security device away from a manhole frame after said security device is unlocked, said lifting tool being adapted to engage said security device in a manner that provides a security feature whereby said latch cannot be released while said lifting tool is engaged to said security device.

16. A security key tool in accordance with claim 15 wherein said tool head is movable between a first position wherein said security key is presented for operation and a second position wherein said lifting tool is presented for operation, and further wherein said tool head is pivotable relative to said longitudinal portion to allow said longitudinal portion to be angled relative to said tool head when said lifting tool is engaged to lift said security device.

17. A security key tool for a manhole security device, comprising:

a longitudinal body portion;

a transverse handle portion;

a security key at a first end of said longitudinal portion adapted to engage a security lock on a manhole security device for actuating a locking mechanism on said security device to an unlocked position;

said security key comprising a set of unevenly spaced longitudinal ridges adapted to engage mating longitudinal grooves formed on said security lock;

a security key cover that is slidably positionable between an extended position wherein said cover protectively surrounds said security key and a retracted position wherein said sleeve does not surround said security key, and further wherein said cover is biased to said extended position; and a latch release tool at a second end of said longitudinal portion adapted to release a latch on said manhole security device for actuating said locking mechanism to a locked position.

18. A security key tool in accordance with claim 17 wherein said latch release tool is disposed on a tool head that also includes a lifting tool adapted to engage and lift said security device away from a manhole frame after said security device is unlocked, said lifting tool being adapted to engage said security device in a manner that provides a security feature whereby said latch cannot be released while said lifting tool is engaged to said security device.

19. A security key tool in accordance with claim 18 wherein said tool head is movable between a first position wherein said security key is presented for operation and a second position wherein said lifting tool is presented for operation, and further wherein said tool head is pivotable relative to said longitudinal portion to allow said longitudinal portion to be angled relative to said tool head when said lifting tool is engaged to lift said security device.

20. A security key tool for a manhole security device, comprising:

a longitudinal body portion;

a transverse handle portion;

a security key at a first end of said longitudinal portion adapted to engage a security lock on a manhole security device for actuating a locking mechanism on said security device to an unlocked position;

a latch release tool at a second end of said longitudinal portion adapted to release a latch on said manhole security device for actuating said locking mechanism to a locked position;

said longitudinal portion and said transverse portion being arranged such that said security key tool is generally tee-shaped;

said transverse portion being proximate to said second end of said longitudinal portion;

said latch release tool being disposed on a tool head that also includes a lifting tool adapted to engage and lift said security device away from a manhole frame after said security device is unlocked;

said tool head being movable between a first position wherein said security key is presented for operation and a second position wherein said lifting tool is presented for operation;

said tool head being pivotable relative to said longitudinal portion to allow said longitudinal portion to be angled relative to said tool head when said lifting tool is engaged to lift said security device; and said security key comprising one of a curvilinear ridge adapted to engage a mating curvilinear groove formed on said security lock or a set of unevenly spaced longitudinal ridges adapted to engage mating longitudinal grooves formed on said security lock.

* * * * *